US009695541B2

(12) United States Patent
Kim et al.

(10) Patent No.: US 9,695,541 B2
(45) Date of Patent: Jul. 4, 2017

(54) DRUM WASHING MACHINE

(71) Applicant: SAMSUNG ELECTRONICS CO., LTD., Suwon-si, Gyeonggi-do (KR)

(72) Inventors: Jin Doo Kim, Hwaseong-si (KR); Jung Hyuk Lee, Suwon-si (KR); Kyung Up Lim, Seoul (KR); Nam Kyu Jun, Uijeongbu-si (KR); Yong Sok Lee, Suwon-si (KR); Hyung Sub Lim, Suwon-si (KR); Min Hee Kang, Busan (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 838 days.

(21) Appl. No.: 13/966,858

(22) Filed: Aug. 14, 2013

(65) Prior Publication Data

US 2014/0047869 A1 Feb. 20, 2014

(30) Foreign Application Priority Data

Aug. 16, 2012 (KR) ..... 10-2012-0089752
Aug. 16, 2012 (KR) ..... 10-2012-0089753
Feb. 4, 2013 (KR) ..... 10-2013-0012550

(51) Int. Cl.
*D06F 39/08* (2006.01)
*D06F 58/22* (2006.01)
*D06F 25/00* (2006.01)

(52) U.S. Cl.
CPC ..... *D06F 39/083* (2013.01); *D06F 25/00* (2013.01); *D06F 58/22* (2013.01)

(58) Field of Classification Search
CPC ..... D06F 58/22
See application file for complete search history.

(56) References Cited

U.S. PATENT DOCUMENTS 9,194,073 B2 11/2015 Kwon et al.
2004/0221474 A1 11/2004 Slutsky et al.
(Continued)

FOREIGN PATENT DOCUMENTS

CN 1932126 3/2007
CN 102428226 4/2012
(Continued)

OTHER PUBLICATIONS

Extended European Search Report issued Oct. 24, 2013 in corresponding European Application No. 13180001.3.
(Continued)

*Primary Examiner* — Joseph L Perrin
*Assistant Examiner* — Irina Graf
(74) *Attorney, Agent, or Firm* — Staas & Halsey LLP

(57) ABSTRACT

A drum washing machine and a control method thereof. The drum washing machine includes a cabinet, a tub including a first tub part and a second tub part, a drum, an inlet provided at one side of the second tub part and supplying condensed water, and at least one flow path provided on one surface from among the inner surfaces of the second tub part opposite the drum and guiding flow of the condensed water to increase a contact area between the condensed water supplied from the inlet and the second tub part. The drum washing machine improves the structure of the tub to effectively inject condensed water, and may thus increase condensing efficiency. Further, the drum washing machine improves the structures of the tub and the drying duct, and may thus prevent accumulation of lint and lowering of performance of the drum washing machine.

10 Claims, 26 Drawing Sheets

(56) References Cited

U.S. PATENT DOCUMENTS

| | | | | |
|---|---|---|---|---|
| 2009/0165330 | A1* | 7/2009 | Krausch | D06F 58/22 34/480 |
| 2010/0223960 | A1* | 9/2010 | Kim | D06F 25/00 68/20 |
| 2011/0277513 | A1* | 11/2011 | Oak | D06F 25/00 68/20 |
| 2012/0090189 | A1 | 4/2012 | Kwon et al. | |

FOREIGN PATENT DOCUMENTS

| | | |
|---|---|---|
| GB | 2 219 652 | 12/1989 |
| WO | WO 01/96647 | 12/2001 |
| WO | WO 2005/017249 | 2/2005 |
| WO | WO 2005/054563 | 6/2005 |

OTHER PUBLICATIONS

Chinese Office Action dated Jan. 25, 2017 from Chinese Patent Application No. 201310359030.7, 10 pages.

* cited by examiner

DRUM WASHING MACHINE

CROSS-REFERENCE TO RELATED APPLICATIONS

This application claims the benefit of Korean Patent Application No. 10-2012-0089752, filed on Aug. 16, 2012 in the Korean Intellectual Property Office, the disclosure of which is incorporated herein by reference.

BACKGROUND

1. Field

Embodiments of the present disclosure relate to a drum washing machine which improves a condensation structure and prevents accumulation of lint, and a control method thereof.

2. Description of the Related Art

In general, a drum washing machine having a drying function is provided with a drying device blowing hot air generated from a drying heater to a space in which laundry is accommodated to dry the laundry, and independently performs the drying function using the drying device or performs the drying function in connection with a washing function after spin-drying has been completed.

The drying device of the washing machine evaporates moisture of laundry by heating the laundry by supplying hot air generated from a heating device to the inside of a drum, and dries the laundry by condensing the evaporated moisture and then discharging condensed water.

When drying of laundry is carried out using such a drying device, lint is generated. Such lint may be attached to an air blower fan or a heater in the drying device, resulting in damage to these components, and thus performance of the drying device may be lowered. Therefore, prevention of accumulation of lint within the drum washing machine is required.

SUMMARY

Therefore, it is an aspect of the present disclosure to provide a drum washing machine which improves the structure of a tub to increase condensing efficiency and prevents lint from flowing from the tub into a drying duct.

It is another aspect of the present disclosure to provide a drum washing machine which improves the structure of a drying duct to prevent lint from accumulating in the drying duct.

Additional aspects of the disclosure will be set forth in part in the description which follows and, in part, will be apparent from the description, or may be learned by practice of the disclosure.

In accordance with one aspect of the present disclosure, a drum washing machine includes a cabinet, a tub disposed within the cabinet and including a first tub part and a second tub part combined with the rear surface of the first tub part, a drum rotatably disposed within the tub, an inlet provided at one side of the second tub part and supplying condensed water to one surface of the second tub part opposite the rear surface of the drum, and at least one flow path provided on one surface from among the inner surfaces of the second tub part opposite the drum and guiding flow of the condensed water to increase a contact area between the condensed water supplied from the inlet and the second tub part.

The at least one flow path may be inclined to guide the flow of the condensed water to the lower portion of the tub.

The at least one flow path may be a rib provided on one surface of the second tub in the horizontal direction and protruding from the surface of the second tub.

The at least one flow path may include a first flow path provided in the horizontal direction and a second flow path provided in a direction differing from the first flow path.

The at least one flow path may include an inclined part and a prevention projection protruding upwardly to prevent the condensed water from flowing backward.

The at least one flow path may include plural flow paths, and the inclined part of the flow path located at the upper region and the inclined part of the flow path located at the lower region may be inclined in opposite directions.

The second tub part may include a hole for circulation of air, and a plurality of protrusions provided in at least one direction and located around the hole.

The plurality of protrusions may include first protrusions and second protrusions provided in a first direction vertical to the rotating direction of the tub, and the first protrusions may be located at the upper position than the second protrusions.

The first protrusions may be inclined in the counterclockwise direction, and the second protrusions may be inclined in the clockwise direction.

The plurality of protrusions may include third protrusions and fourth protrusions provided in a second direction identical to the rotating direction of the tub, and the minimum distance between the third protrusions and the center of the tub may be smaller than the minimum distance between the fourth protrusions and the center of the tub.

The drum washing machine may further include a nozzle located within the second tub part and increasing an injection area of the condensed water within the tub.

The drum washing machine may further include a drying duct provided with an air blower fan located therein so as to heat air to supply the heated air to the inside of the drum and to heat low temperature air generated from the drum to circulate the heated air, and connected to the drum.

A first water supply pipe injecting wash water to the air blower fan to prevent accumulation of lint on the air blower fan may be connected to one side of the drying duct.

One side of the first water supply pipe may be branched from a second water supply pipe supplying wash water to the tub.

A switching valve to control injection of wash water to the air blower fan may be combined with the first water supply pipe.

In accordance with another aspect of the present disclosure, a drum washing machine includes a cabinet, a tub disposed within the cabinet and condensing air, a drum rotatably disposed within the tub, a drying duct heating and circulating air condensed by the tub, and a first water supply pipe connected to one side of the drying duct and injecting wash water to the side of the drying duct to prevent accumulation of lint within the drying duct.

The first water supply pipe may be branched from a second water supply pipe supplying wash water to the tub.

The first water supply pipe may be connected to an external water supply source, and include a first water supply switching valve to adjust opening and closing of the first water supply pipe.

The drying duct may include a mount part in which an air blower fan is located, and the first water supply pipe may be connected to a water supply pipe connector provided on one side surface of the mount part.

The tub may include a first tub part and a second tub part combined with the rear surface of the first tub part, an inlet to supply condensed water to at least one of the second tub part and the drum may be provided at one side of the second tub part, and a hole for circulation of air may be provided within the second tub part.

At least one flow path guiding flow of the condensed water may be provided on one surface of the second tub part to increase a contact area between the condensed water supplied from the inlet and the second tub part.

At least one flow path guiding flow of the condensed water may be provided on one surface of the drum to increase a contact area between the condensed water supplied from the inlet and the drum.

In accordance with another aspect of the present disclosure, a drum washing machine includes a cabinet, a tub including a first tub part disposed within the cabinet and a second tub part combined with the rear surface of the first tub part, and a drum rotatably disposed within the tub, wherein the second tub part includes a cylindrical member provided in the circumferential direction, a rear plate located on the rear surface of the cylindrical member, an inlet provided at one side of the cylindrical member and supplying condensed water, a hole provided at the other side of the cylindrical member and circulating air, and a plurality of protrusions provided in at least one direction and located around the hole to prevent accumulation of lint generated due to rotation of the tub.

The drum washing machine may further include at least one flow path located on the rear wall of the second tub part in the horizontal direction and guiding flow of the condensed water to increase a contact area between the condensed water supplied from the inlet and the second tub part.

In accordance with another aspect of the present disclosure, a drum washing machine includes a cabinet, a tub disposed within the cabinet, a drum rotatably disposed within the tub, a drying duct performing drying of laundry in the drum, a mount part in which an air blower fan for circulation of air is located, and a plurality of first lint collection parts protruding from the outer circumferential surface of the mount part and preventing inflow of lint into the air blower fan.

The plurality of first lint collection parts may extend from the mount part to the tub.

The plurality of first lint collection parts may extend from the outer region of the mount part to the center of the mount part.

The lengths of the plurality of first lint collection parts may be different.

From among the plurality of first lint collection parts, the length of a first lint collection part located at the central region may be greater than the length of a first lint collection part located at the outer region.

The width of the plurality of first lint collection parts may be decreased in the extension direction of the plurality of first lint collection parts from the mount part.

The drum washing machine may further include a connection member connecting one side of the drying duct to one side of the tub.

A plurality of second lint collection parts protruding in the central direction of the connection member to collect lint may be provided on the inner surface of the connection member.

The plurality of second lint collection parts may be provided so as to surround the inner wall of the connection member.

The plurality of second lint collection parts may be formed of a flexible material.

At least one communication part into which dry air at the outside of the tub flows may be provided on at least one surface of the mount part.

The at least one communication part may be formed by a concave surface formed on at least a portion of the mount part.

In accordance with another aspect of the present disclosure, a drum washing machine includes a cabinet, a tub disposed within the cabinet, a drum rotatably disposed within the tub, a drying duct in which an air blower fan circulating air to perform drying of laundry in the drum is located, a connection member connecting the drying duct to the tub, and lint collection parts provided integrally with the inner surface of at least one of the drying duct and the connection member and preventing inflow of lint into the air blower fan.

The lint collection parts may include first lint collection parts provided on the inner surface of the drying duct and second lint collection parts provided on the inner surface of the connection member.

The first lint collection parts may be protruded from the mount part in which the air blower fan is located, to the tub.

The first lint collection parts may be protruded from the outer region of the mount part in which the air blower fan is located, to the center of the mount part.

The second lint collection parts may include a plurality of protrusions, and the plurality of protrusions may be located in the circumferential direction of the inner wall of the connection member.

In accordance with another aspect of the present disclosure, a drum washing machine includes a cabinet, a tub disposed within the cabinet, a drum rotatably disposed within the tub, a drying duct performing drying of laundry in the drum, a mount part in which an air blower fan for circulation of air is located, and at least one communication part located at one side of the mount part, dry air at the outside of the tub flowing into the at least one communication part by the air blower fan.

The at least one communication part may be formed by a concave surface formed on at least a portion of the mount part.

The drum washing machine may further include a connection member connecting the drying duct to the tub and lint collection parts provided integrally with the inner surface of at least one of the drying duct and the connection member and preventing inflow of lint into the air blower fan.

In accordance with yet another aspect of the present disclosure, a control method of a drum washing machine which has a tub, a drum rotatably disposed within the tub, a heater heating air condensed by the tub, and a drying duct in which an air blower fan for circulation of air is located, includes performing a drying cycle, performing a cooling cycle in which the heater is turned off and the air blower fan is periodically turned on and off, and performing an injecting cycle in which water is injected into the air blower fan during at least one of the cooling cycle and the drying cycle.

Turning-off of the air blower fan for at least 5 seconds and then turning-on of the air blower fan may be periodically repeated.

The cooling cycle may be performed if a time left until the end point of time of the drying cycle, acquired by measuring the progressing time of the drying cycle, is shorter than a designated time.

The cooling cycle may be started if the time left until the end point of time of the drying cycle is about 5 to 10 minutes.

The injecting cycle may be performed only during the cooling cycle by a first water supply switching valve provided on the drying duct.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
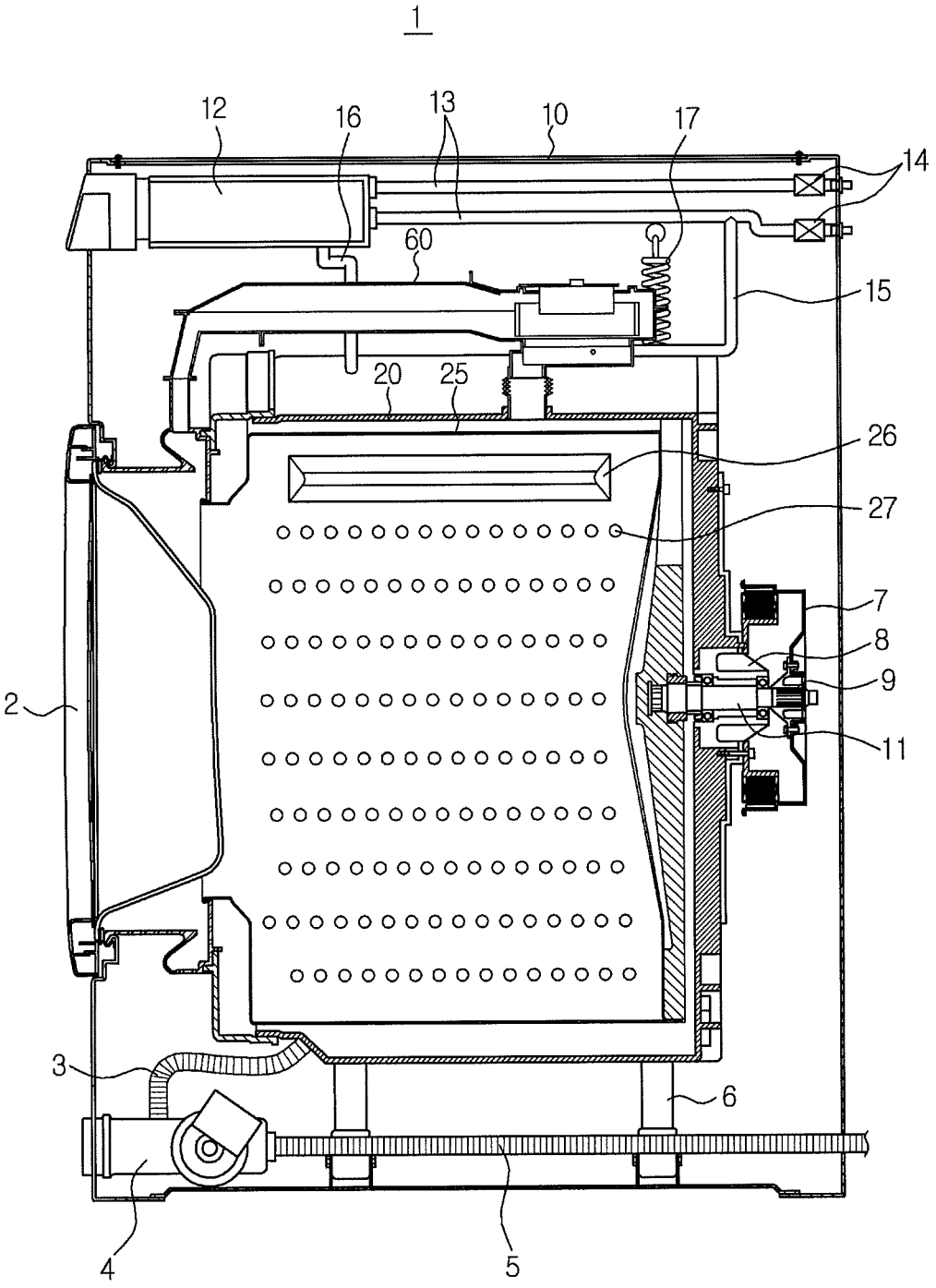
FIG. 1 is a cross-sectional view of a drum washing machine in accordance with one embodiment of the present disclosure.

Reference will now be made in detail to the embodiments of the present disclosure, examples of which are illustrated in the accompanying drawings, wherein like reference numerals refer to like elements throughout.

Figure 2:
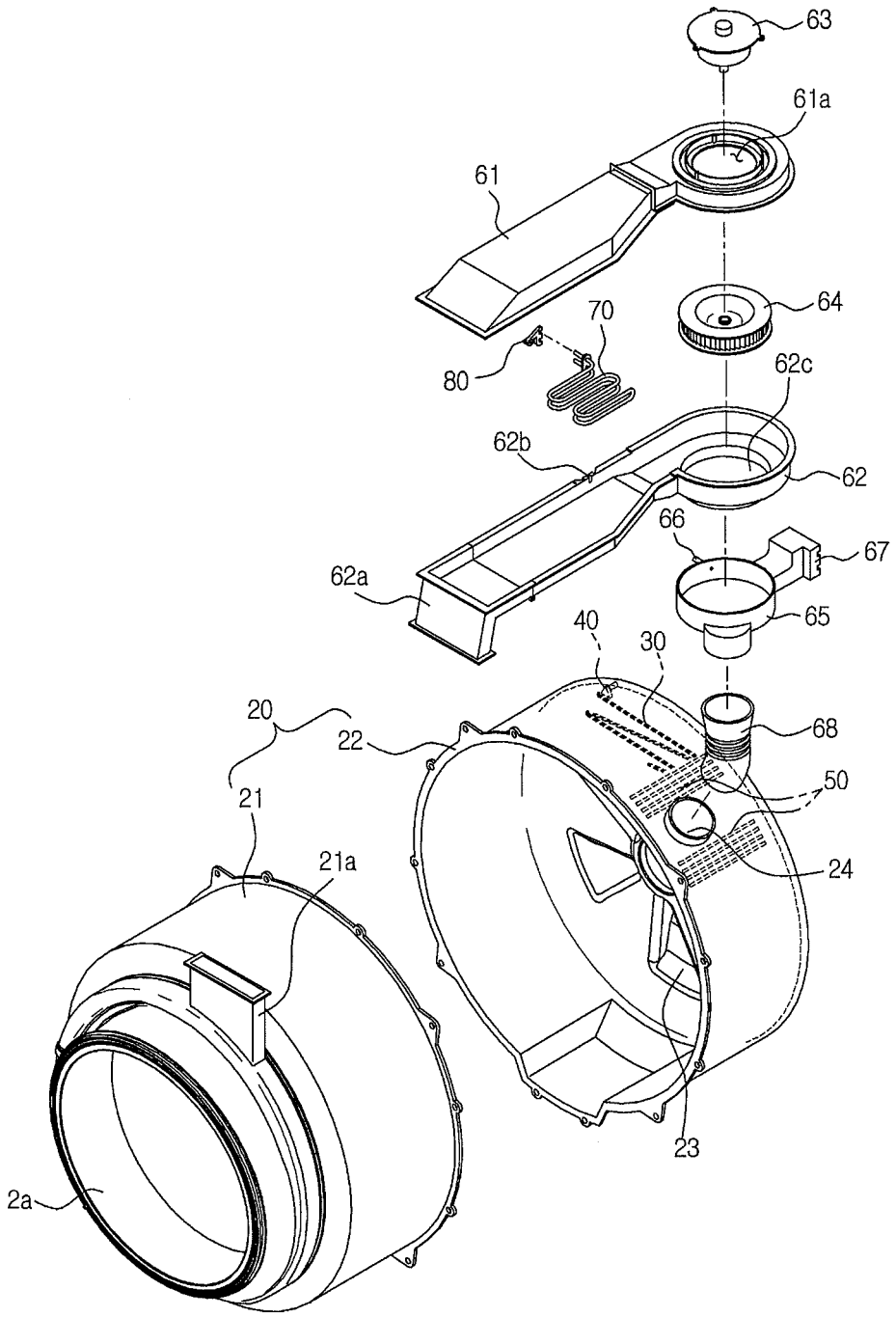
FIG. 2 is an exploded view of the drum washing machine in accordance with the embodiment of the present disclosure.

FIG. 1 is a cross-sectional view of a drum washing machine in accordance with one embodiment of the present disclosure, and FIG. 2 is an exploded view of the drum washing machine in accordance with the embodiment of the present disclosure.

As shown in FIGS. 1 and 2, a drum washing machine 1 includes a cabinet 10, a tub 20 disposed within the cabinet 10, a drum 25 rotatably disposed within the tub 20, and a motor 7 driving the drum 25.

The tub 20 may include a first tub part 21 located in the front portion of the inside of the cabinet 10, and a second tub part 22 combined with the rear surface region of the first tub part 21. The first tub part 21 includes a cylindrical member provided in the circumferential direction, and a front plate located on the front surface of the cylindrical member. The second tub part 22 includes a cylindrical member 22*a* (FIG. 4) provided in the circumferential direction, and a rear plate 22*b* located on the rear surface of the cylindrical member 22*a*. The cylindrical member of the first tub part 21 and the cylindrical member 22*a* of the second tub part 22 are combined, thus constituting the tub 20.

The cabinet 10 includes frames. The frames of the cabinet 10 include a front frame and a rear frame forming the front and rear surfaces of the cabinet 10, and side frames and a lower frame connecting the front frame and the rear frame and forming the side and lower surfaces of the cabinet 10.

An inlet through which laundry is put into the drum 25 is formed on the front frame of the cabinet 10. The inlet is opened and closed by a door 2 installed on the front frame of the cabinet 10.

A spring 17 to support the tub 20 from the top may be provided between the tub 20 and the cabinet 10. The spring 17 serves to attenuate vibration and noise generated due to movement of the tub 20 using elasticity of the spring 17.

Figure 6:
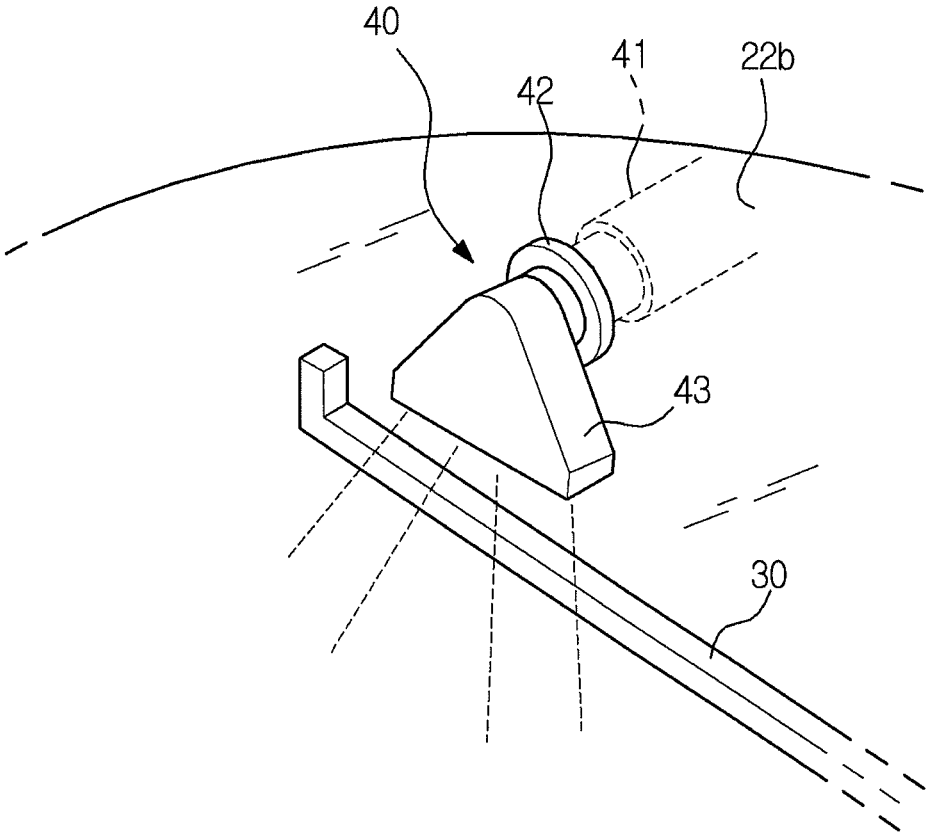
FIG. 6 is an enlarged view of a nozzle in accordance with one embodiment of the present disclosure.

Second water supply pipes 13 to supply wash water to the tub 20 are installed above the tub 20. A first water supply pipe 15 is connected to one end of a drying duct 60, and a detailed description thereof will be given later. One end of each of the second water supply pipes 13 is connected to an external water supply source (not shown), and the other end of each of the second water supply pipes 13 is connected to a detergent supply device 12. Further, an inlet 41 through which condensed water is supplied to the tub 20 is provided at the front portion of the tub 20. Further, a valve (not shown) to adjust supply of condensed water may be provided in the inlet 41 (FIG. 6). The inlet 41 may be provided on the cylindrical member 22*a* of the second tub part 22. The reason for this is that a drying device is provided in the rear portion of the inside of the cabinet 10. The inlet 41 may communicate with a nozzle 40 to inject water, and a detailed description thereof will be given later.

The detergent supply device 12 is connected to the tub 20 through a connection pipe 16. Water supplied through the second water supply pipes 13 passes through the detergent supply device 12, and is then supplied to the inside of the tub 20 together with detergent. In accordance with one embodiment of the present disclosure, the detergent supply device 12 may be connected to the first tub part 21 through the connection pipe 16. The reason for this is that the detergent supply device 12 is located in the front portion of the inside of the cabinet 10.

The tub 20 is supported by dampers 6. The dampers 6 connect the outer surface of the tub 20 to the inner bottom surface of the cabinet 10. Further, the dampers 6 may be located on the upper and both side surfaces of the cabinet 10 in addition to the inner bottom surface of the cabinet 10 so as to support the tub 20. The dampers 6 or the spring 17 located on and below the tub 20 may reduce vibration and impact generated due to vertical movement of the tub 20.

A drive shaft 11 to transmit the power of the motor 7 is connected to the rear surface of the drum 25. Plural through holes 27 for circulation of wash water are formed on the circumference of the drum 25. Plural lifters 26 to tumble laundry when the drum 25 is rotated are installed on the inner circumferential surface of the drum 25.

The drive shaft 11 is disposed between the drum 25 and the motor 7. One end of the drive shaft 11 is connected to the rear plate of the drum 25, and the other end of the drive shaft 11 is extended to the outside of the rear wall of the tub 20. When the motor 7 drives the drive shaft 11, the drum 25 connected to the drive shaft 11 is rotated about the drive shaft 11.

A bearing housing 8 rotatably supporting the drive shaft 11 is installed on the rear plate 22*b* of the second tub part 22. The bearing housing 8 may be formed of an aluminum alloy, and be inserted into the rear wall of the second tub part 22 when the second tub part 22 is formed by injection molding. Bearings 9 facilitating rotation of the drive shaft 11 are installed between the bearing housing 8 and the drive shaft 11.

A drain pump 4 to discharge water in the tub 20 to the outside of the cabinet 10, a connection hose 3 connecting the tub 20 to the drain pump 4 so that water in the tub 20 may flow into the drain pump 4, and a drain hose 5 guiding water pumped by the drain pump 4 to the outside of the cabinet 10 are provided under the tub 20.

Condensed water is supplied to the tub 20 through the inlet 41. Condensed water may be supplied to the tub 20 by the nozzle 40 through the inlet 41. Condensed water supplied to the tub 20 flows down along the inner rear surface of the tub 20, and is discharged to the outside through the drain pump 4 and the drain hose 5 under the tub 20.

A drying device which dries air within the tub 20 and then supplies the dried air back to the inside of the tub 20 is installed on the tub 20. In accordance with one embodiment of the present disclosure, the drying device includes the tub 20 condensing moisture in air, and the drying duct 60 heating the air from which moisture is condensed and supplying the heated air to the inside of the drum 25.

The drying duct 60 may be combined with the second tub part 22. A connection member 68 serving to connect one end of the drying duct 60 to one end of the second tub part 22 may be interposed between the second tub part 22 and the drying duct 60. That is, the connection member 68 may be located between one end of the drying duct 60 through which air from the tub 20 flows into the drying duct 60 and the tub 20.

An air blower fan 64 forming circulation flow of air so that air in the tub 20 flows into the drying duct 60 and is then supplied back to the inside of the tub 20 is located between the drying duct 60 and the tub 20. A heater 70 heating air in the drying duct 60 is installed in the drying duct 60. The connection member 68 serving to connect one end of the drying duct 60 to the tub 20 may be provided between the drying duct 60 and the tub 20.

A mount part 65 in which the air blower fan 64 is mounted may be located under the drying duct 60. A support part 67 to fix the drying duct 60 to the mount part 65 may be provided at one side of the mount part 65. A coupling member is combined with one side of the support part 67 and one side of the drying duct 60, thus combining the drying duct 60 and the support part 67 with each other.

A communication part 62*a* extended from one side of the drying duct 60 is combined with a front panel 21*a* extended from one side of the first tub part 21. Thereby, air circulates between the tub 20 and the drying duct 60.

Figure 3:
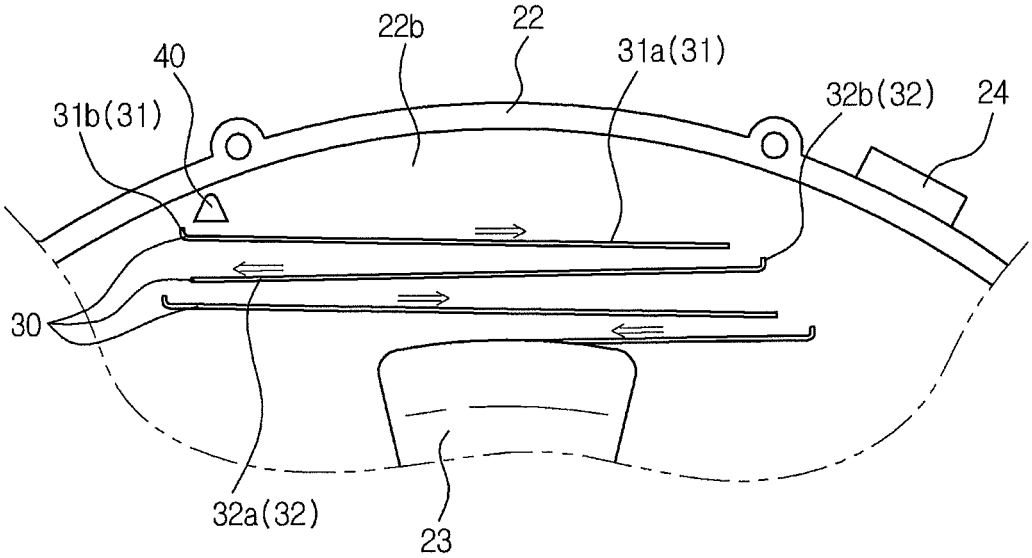
FIG. 3 is an enlarged view of a rear plate of a tub in accordance with the embodiment of the present disclosure.

FIG. 3 is an enlarged view of the rear plate of the tub in accordance with the embodiment of the present disclosure.

As shown in FIG. 3, flow paths 30 guiding flow of condensed water supplied from the inlet 41 may be provided on the rear plate 22*b* of the second tub part 22. The flow paths 30 may be provided in a rib shape protruding from the second tub part 22. The flow paths 30 may be provided on the rear plate 22*b* of the second tub part 22 in the horizontal direction. The flow paths 30 may be inclined to guide flow of condensed water to the lower portion of the second tub part 22. The flow paths 30 serve to increase a contact area between the second tub part 22 and condensed water. Reinforcing ribs 23 to reinforce the rigidity of the tub 20 may be provided in various shapes under the flow paths 30.

The flow paths 30 may include inclined parts 31*a* and 32*a*, and prevention projections 31*b* and 32*b* to prevent condensed water from flowing backward. The prevention projections 31*b* and 32*b* may protrude upward. The inclined part 31*a* or 32*a* guiding flow of condensed water is provided at one side of each of the flow paths 30, and the prevention projection 31*b* or 32*b* is provided at one side of the inclined part 31*a* or 32*a*, thus guiding the flow of condensed water in one direction.

A plurality of flow paths 30 may be provided, and the inclined parts 31*a* of the upper flow path 31 and the inclined part 32*a* of the lower flow path 32 may be inclined in opposite directions. Thereby, condensed water flows in a zigzag shape along the flow paths 31. Arrows of FIG. 3 represent the flow of the condensed water. This may increase a contact area between the condensed water and the second tub part 22, as compared to the case in that the inclined parts 31*a* and 32*a* of the flow paths 30 are provided in one direction, and thus raise condensing efficiency.

When condensed water flows down to the lower portion of the second tub part 22 along the flow paths 30, high temperature air flowing into the tub 20 via the drum 25 passes through the rear plate 22*b* of the second tub part 22, and flows into the drying duct 60 via a hole 24 provided on the second tub part 22. Such high temperature air contacts condensed water flowing down along the flow paths 30, and heat exchange between the high temperature air and the condensed water occurs. Thereby, the temperature of the air is lowered and thus low temperature air flows into the drying duct 60, and the drying duct 60 removes moisture from the low temperature air. The hole 24 communicating with the drying duct 60 so that the low temperature air having exchanged heat with the condensed water may flow into the drying duct 60 is located at the upper portion of the rear plate 22*b* of the second tub part 22.

Although one embodiment of the present disclosure illustrates the flow paths 30 as being located on the rear plate 22*b* of the second tub part 22, if the inlet 41 is located on the front surface of the tub 20, the condensed water may drop to the drum 25, and thus the flow paths 30 may be provided on the rear surface of the drum 25.

Figure 4:
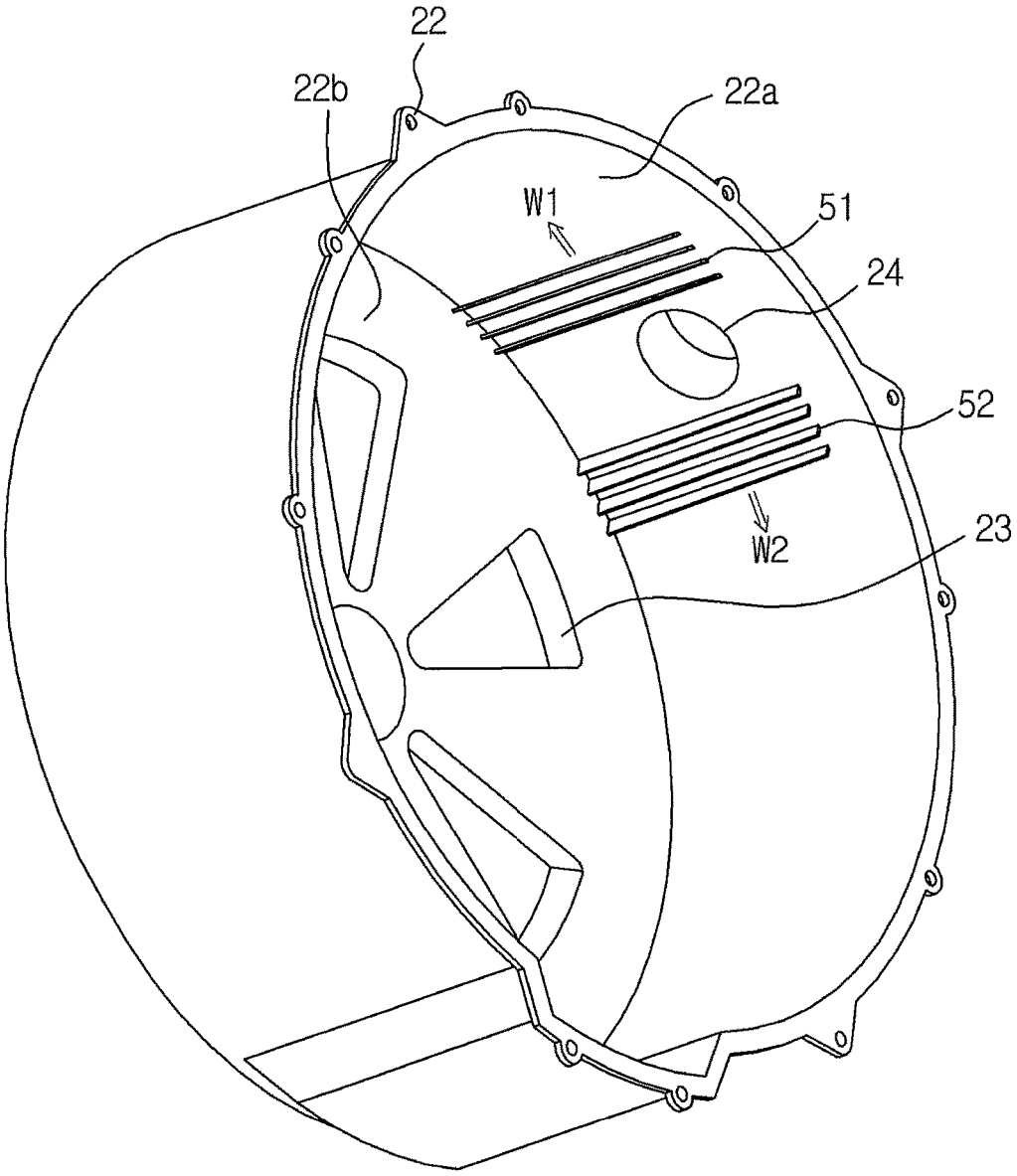
FIG. 4 is an enlarged view of the tub in accordance with the embodiment of the present disclosure.

FIG. 4 is an enlarged view of the tub in accordance with the embodiment of the present disclosure.

As shown in FIG. 4, a plurality of protrusions 50 may be located on the cylindrical member 22*a* of the second tub part 22 provided in the circumferential direction. The protrusions 50 may be located around the hole 24. This serves to prevent lowering of drying efficiency due to inflow of lint, generated from laundry within the drum 25, from the tub 20 into the drying duct 60 if the lint flows into the tub 20.

The protrusions 50 may include first protrusions 51 located at one side of the hole 24, and second protrusions 52 located at the other side of the hole 24. The first protrusions 51 and the second protrusions 52 are provided in a first direction vertical to the rotating direction of the tub 20. The first protrusions 51 and the second protrusions 52 may protrude from the cylindrical member 22*a* of the second tub part 22 by 3 mm or more. Plural first protrusions 51 and plural second protrusions 52 may be provided. The plural first protrusions 51 and the plural second protrusions 52 may be separated from one another by a designated interval or more. For example, interval between the plural first protrusions 51 and the interval between the plural second protrusions 52 may be 20 mm The first protrusions 51 and the second protrusions 52 may be inclined from the cylindrical member 22*a* of the second tub part 22. The first protrusions 51 may be inclined in the counterclockwise direction w1, and the second protrusions 52 may be inclined in the clockwise direction w2. If the tub part 22 is rotated in the clockwise direction w2, the first protrusions 51 serve to prevent inflow of lint into the hole 24, and if the tub part 22 is rotated in the counterclockwise direction w2, the second protrusions 52 serve to prevent inflow of lint into the hole 24. Since the first protrusions 51 and the second protrusions 52 are inclined in opposite directions, even if the tub 20 is rotated in different directions, inflow of lint into the hole 24 may be prevented.

Figure 5:
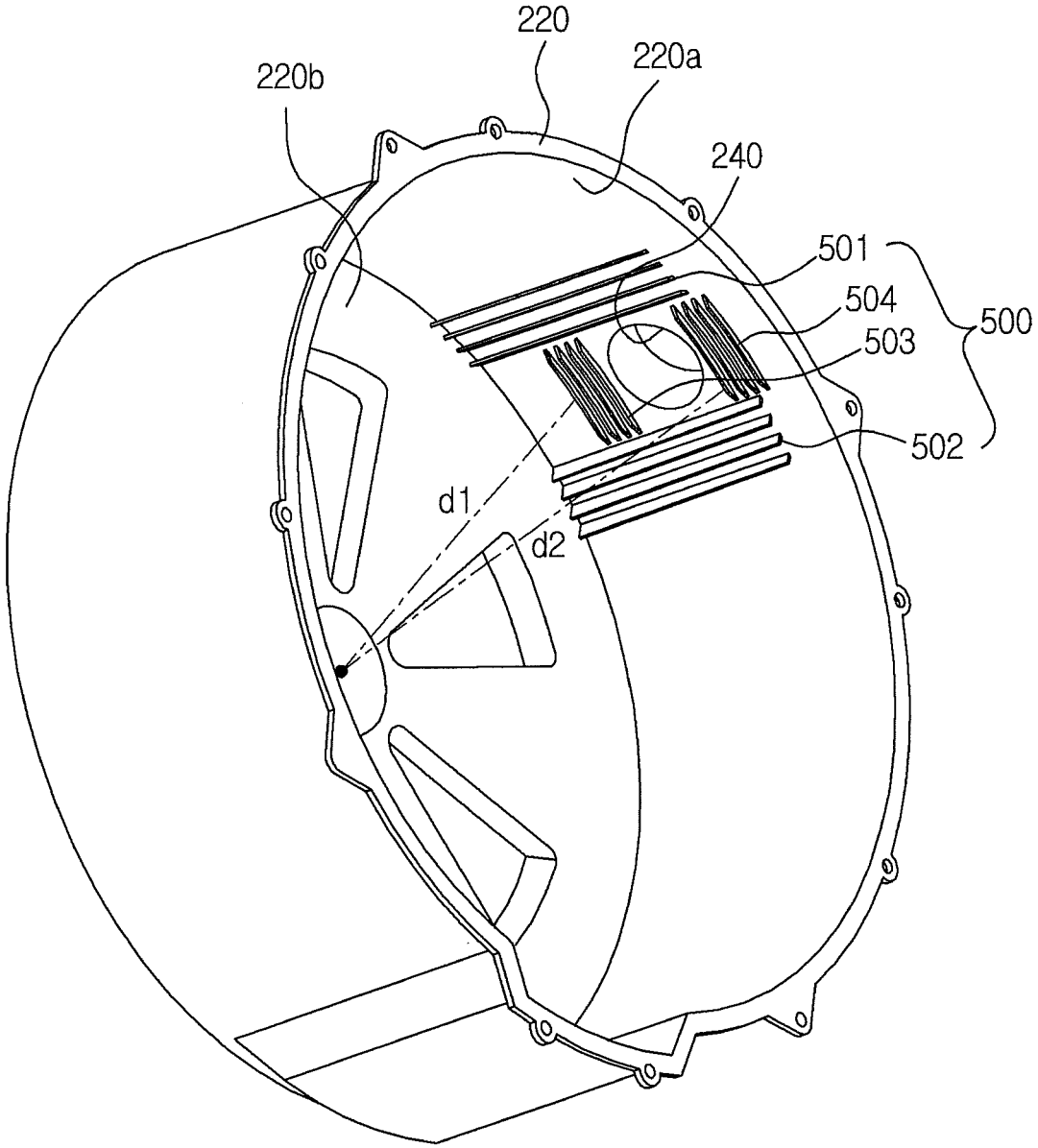
FIG. 5 is an enlarged view of a tub in accordance with another embodiment of the present disclosure.

FIG. 5 is an enlarged view of a tub having a second tub part 220, cylindrical member 220*a* and rear plate 220*b* in accordance with another embodiment of the present disclosure.

In accordance with this embodiment, as shown in FIG. 5, protrusions 500 may include third protrusions 503 and fourth protrusions 504, in addition to first protrusions 501 and second protrusions 502.

The third protrusions 503 and the fourth protrusions 504 are provided in a direction differing from the first protrusions 501 and the second protrusions 502. For example, if the first protrusions 501 and the second protrusions 502 are provided in a direction vertical to the rotating direction of the tub 20, the third protrusions 503 and the fourth protrusions 504 may be provided in a direction identical to the rotating direction of the tub 20. If the direction vertical to the rotating direction of the tub 20 is defined as a first direction and the rotating direction of the tub 20 is defined as a second direction, the first protrusions 501 and the second protrusions 502 are located in the first direction, and the third protrusions 503 and the fourth protrusions 504 are located in the second direction.

The third protrusions 503 are located closer to the center of the tub 20 than the fourth protrusions 504 based on a hole 240. That is, the minimum distance d1 between the third protrusions 503 and the center of the tub 20 is smaller than the minimum distance d2 between the fourth protrusions 504 and the center of the tub 20.

If the protrusions 500 include the third protrusions 503 and the fourth protrusions 504 in addition to the first protrusions 501 and the second protrusions 502, the protrusions 500 are provided in four directions around the hole 240, and thus accumulation of lint in the drying duct 60 due to inflow of the lint through the hole 240 may be prevented. Thereby, lowering of drying efficiency may be prevented.

Figure 7:
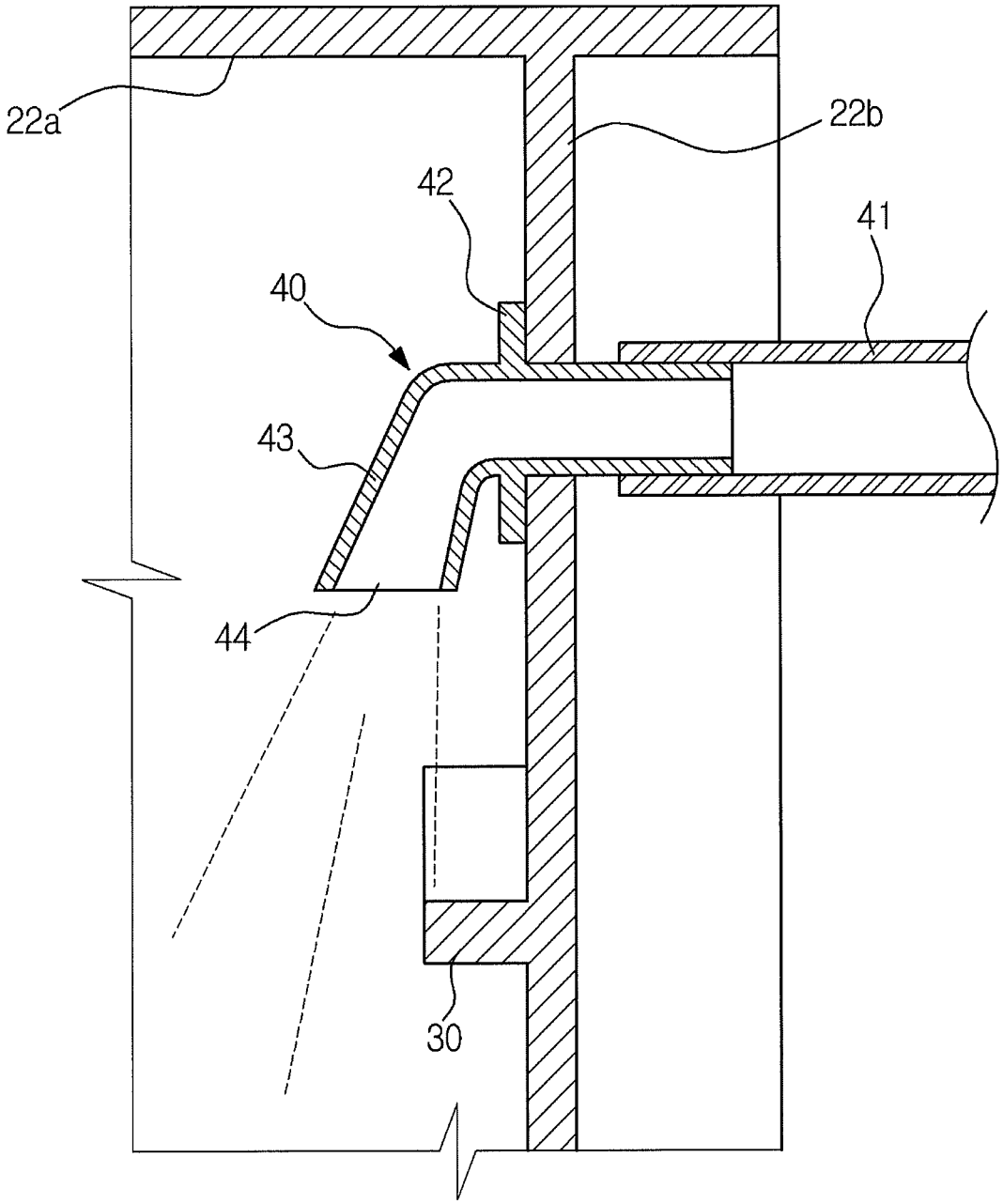
FIG. 7 is a cross-sectional view of the nozzle in accordance with the embodiment of the present disclosure.

FIG. 6 is an enlarged view of a nozzle in accordance with one embodiment of the present disclosure, and FIG. 7 is a cross-sectional view of the nozzle in accordance with the embodiment of the present disclosure.

As shown in FIGS. 6 and 7, the nozzle 40 to inject condensed water may be provided within the tub 20. The nozzle 40 may be formed integrally with the second tub part 22 by injection molding. Otherwise, the nozzle 40 may be provided as a separate member and be combined with the second tub part 22. FIGS. 6 and 7 illustrate the nozzle 40 as being provided as a separate member and being combined with the second tub part 22.

A combination part 42 to be combined with the second tub part 22 is provided at the nozzle 40, and a head 43 of the nozzle 40 extends from the combination part 42. The combination part 42 of the nozzle 40 communicates with the inlet 41 to supply condensed water. An injection hole 44 of the nozzle 40 provided at the end of the head 43 of the nozzle 40 and injecting condensed water is elongated. This serves to increase a contact area between condensed water injected from the nozzle 40 and the tub 20.

As shown in FIGS. 6 and 7, the head 43 of the nozzle 40 may be formed in a triangular shape. This serves to allow condensed water to be injected more widely in the downward direction. The head 43 is not limited to such a shape, and may be formed in other shapes, such as a fan shape, so as to increase the dispersion area of condensed water.

In accordance with one embodiment of the present disclosure, if the nozzle 40 is provided on the rear plate 22*b* of the second tub part 22, condensed water may be periodically injected from the nozzle 40 at designated time intervals.

Figure 8:
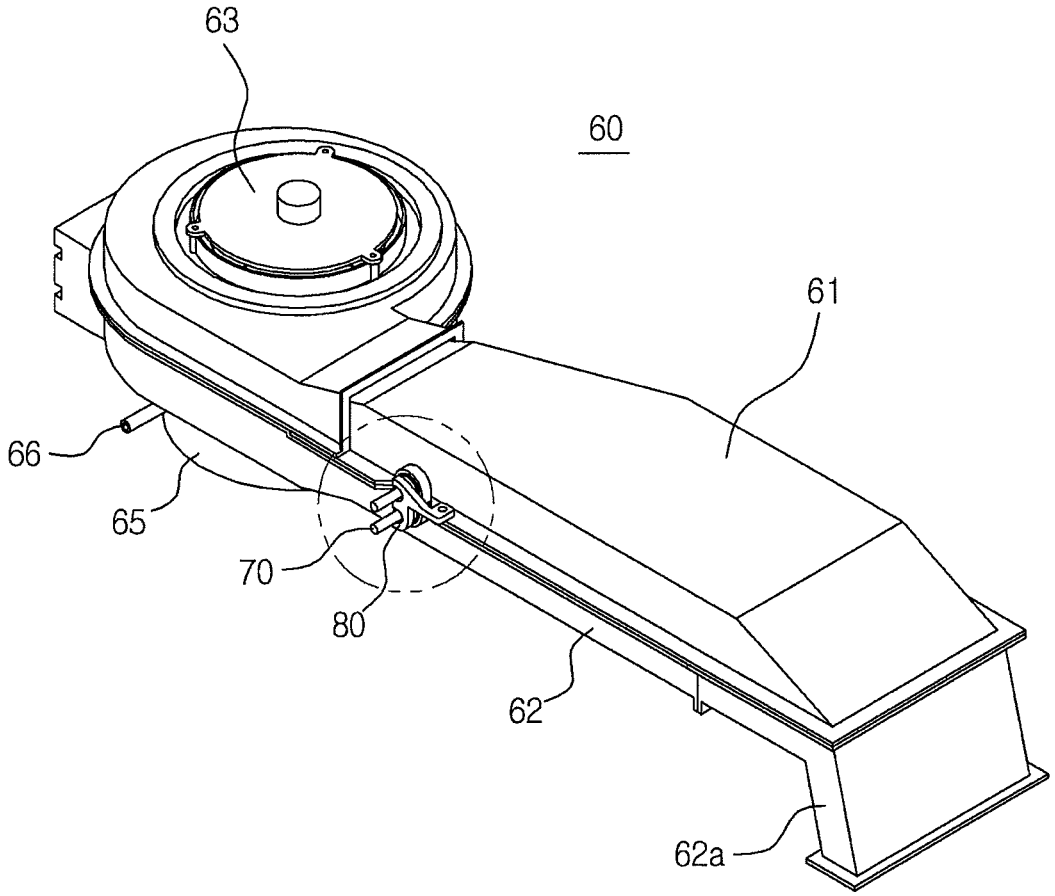
FIG. 8 is a view illustrating a drying duct in accordance with one embodiment of the present disclosure.
Figure 9:
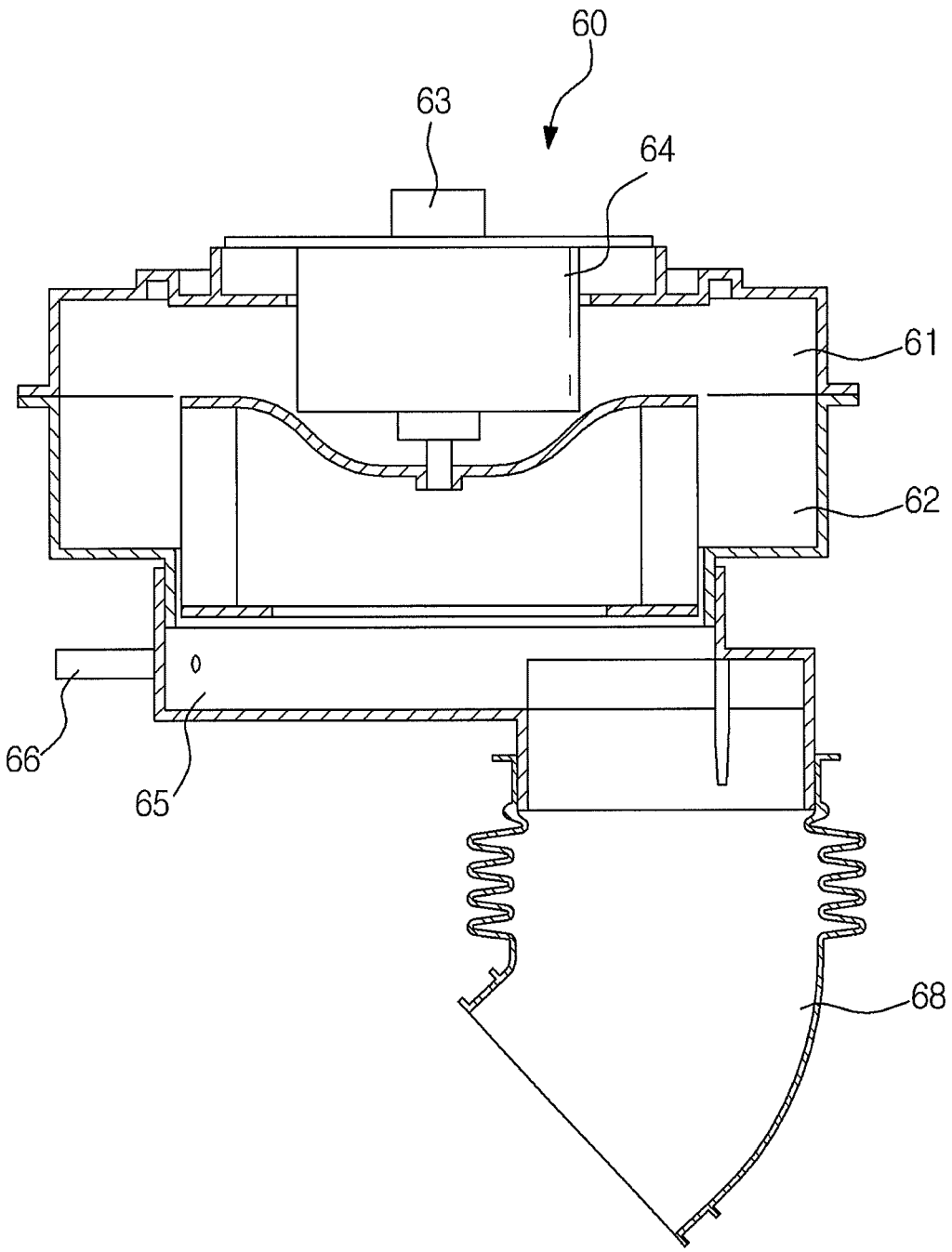
FIG. 9 is a cross-sectional view of the drying duct in accordance with the embodiment of the present disclosure.

FIG. 8 is a view illustrating a drying duct in accordance with one embodiment of the present disclosure, and FIG. 9 is a cross-sectional view of the drying duct in accordance with the embodiment of the present disclosure.

As shown in FIGS. 8 and 9, the drying duct 60 includes an upper plate 61 and a lower plate 62. The heater 70 is provided within the drying duct 60. The upper plate 61 and the lower plate 62 of the drying duct 60 are provided with mount holes 61*a* and 62*c* in which the air blower fan 64 is mounted.

Further, the mount part 65 in which the air blower fan 64 is mounted may be provided. The mount part 65 is combined with the lower portion of the lower plate 62. That is, the mount part 65 may be located between the connection member 68 and the lower plate 62. A water supply pipe connector 66 to inject wash water to the air blower fan 64 and the drying duct 60 is located at one side of the mount part 65. The water supply pipe connector 66 may protrude from the mount part 65. An upper cover 63 is combined with the upper portion of the upper plate 61 and prevents the air blower fan 64 from protruding to the outside.

The heater 70 may be located within the drying duct 60, and a fixing unit 80 to fix the heater 70 may be combined with the drying duct 60. A detailed description thereof will be given later.

Figure 10:
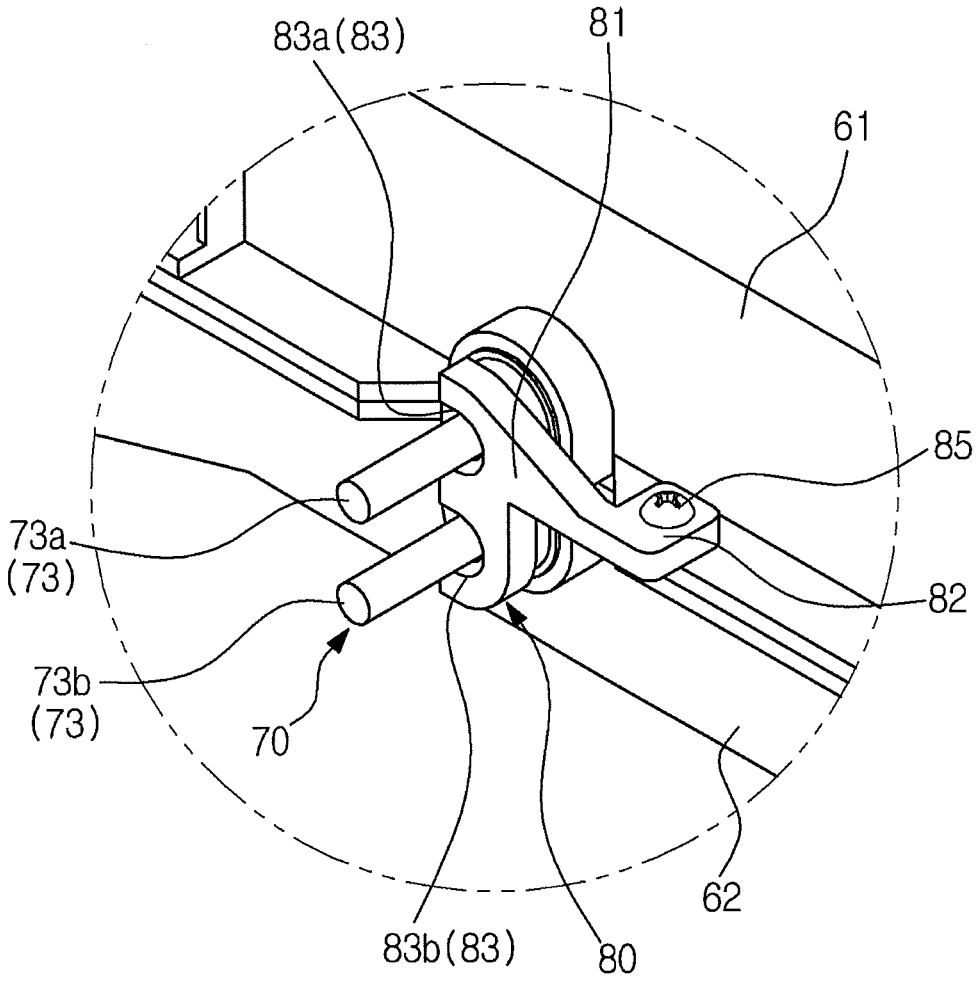
FIG. 10 is an enlarged view of the drying duct in accordance with the embodiment of the present disclosure.
Figure 11:
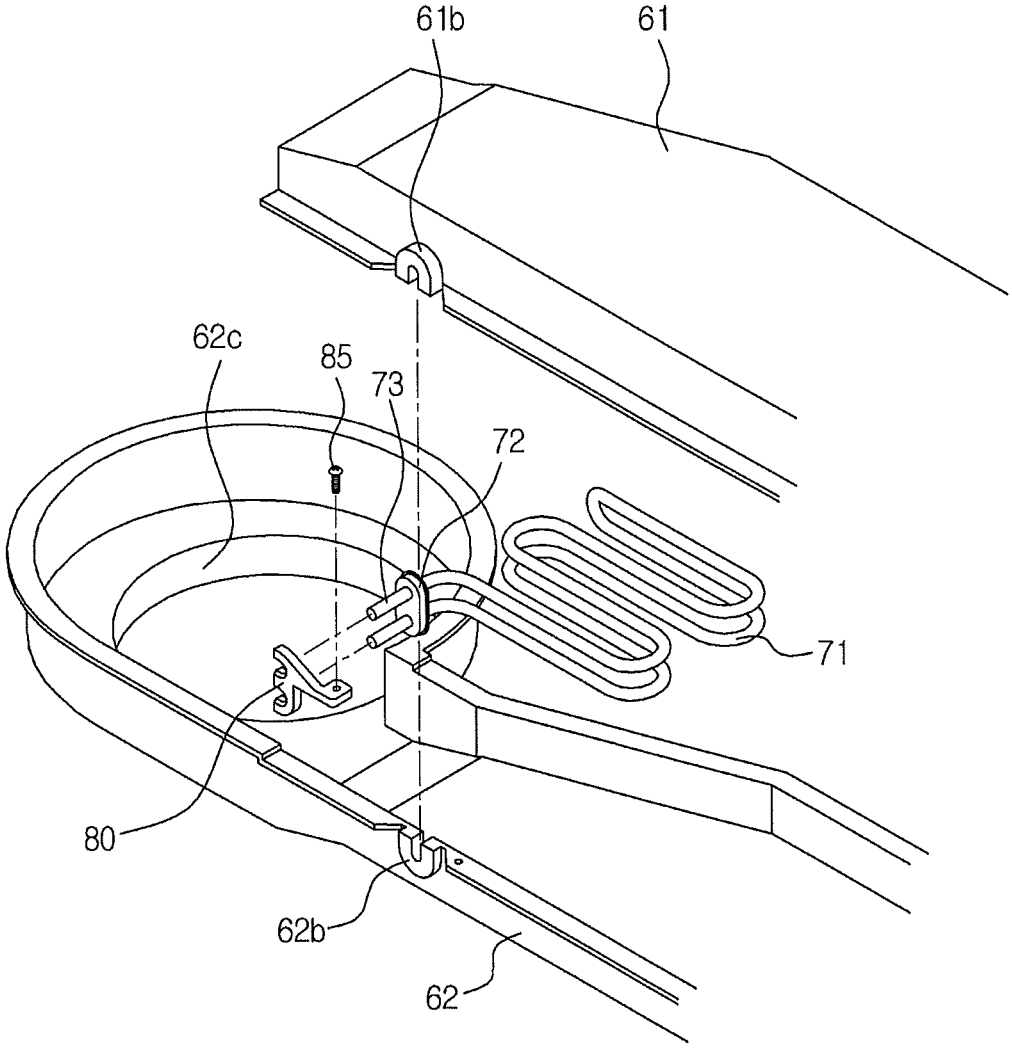
FIG. 11 is an exploded view of the drying duct in accordance with the embodiment of the present disclosure.

FIG. 10 is an enlarged view of the drying duct in accordance with the embodiment of the present disclosure, and FIG. 11 is an exploded view of the drying duct in accordance with the embodiment of the present disclosure.

As shown in FIGS. 10 and 11, the fixing unit 80 to fix the heater 70 located within the drying duct 60 is combined with one side of the drying duct 60.

The heater 70 is formed so as to have a designated diameter and length. The heater 70 may be formed in a zigzag type. The heater 70 includes terminals 73 to which electric wires in which current flows are connected, a sealing member 72 separated from the terminals 73 by a designated distance and preventing air leakage, and a heat generation part 71 extended from the terminals 73. The heat generation part 71 is formed so as to have a designated diameter and length and is bent plural times.

The fixing unit 80 includes a duct combination part 82 combined with the drying duct 60, and a heater combination part 81 combined with the terminals 73 of the heater 70. Terminal combination holes 83 corresponding to the shape of the terminals 73 are provided on the heater combination part 81. As shown in FIGS. 10 and 11, two terminals 73*a* and 73*b* are provided, and thus two terminal combination holes 83 may be provided and the heater combination part 81 may have a "3" shape. The duct combination part 82 is extended from the heater combination part 81. Although one embodiment of the present disclosure illustrates the duct combination part 82 as being combined with the drying duct 60 by a fastening member 85, the embodiments of the present disclosure are not limited thereto. Further, although FIGS. 10 and 11 illustrate the duct combination part 82 as being combined with the upper plate 61 of the drying duct 60, the duct combination part 82 may be combined with the lower plate 62. The heater combination part 81 may be provided so as to surround the terminals 73. The heater combination part 81 may be provided so as to surround ½ or more of the diameter of the terminals 73. This serves to prevent the terminals 73*a* and 73*b* from being separated from the fixing unit 80.

In order to fix the heater 70 to the inside of the drying duct 60, the fixing unit 80 is combined with the outer surfaces of the insertion holes 61*b* and 62*b* provided on the upper plate 61 and the lower plate 62. The insertion holes 61*b* and 62*b* correspond to the shape of the terminals 73 of the heater 70. In accordance with one embodiment of the present disclosure, two terminals 73 are provided, and thus two insertion holes 61*b* and 62*b* are provided. The terminals 73 are inserted into the insertion holes 61*b* and 62*b*, and the sealing member 72 is located at the rear of the insertion holes 61*b* and 62*b*. The fixing unit 80 is combined with the outer surface of the drying duct 60 such that the terminals 73 are inserted into the fixing unit 80.

The fixing unit 80 may be formed of an insulating material. That is, the fixing unit 80 is not formed of a conductor so as to prevent the fixing unit 80 from being overheated due to transfer of heat from the heater 70 to the fixing unit 80. In order to withstand heat generated from the heater 70, the fixing unit 80 may be formed of a material having high heat resistance. In accordance with one embodiment of the present disclosure, the fixing unit 80 may be formed of a material satisfying the above requirement, such as polyphenylene sulfide (PPS) or polyethylene terephtalate (PET).

In accordance with one embodiment of the present disclosure, the heater 70 is fixed to the outer portion of the drying duct 60, and thus, if lint flows into the drying duct 60, an accident caused by combustion of accumulated lint due to heat generated from the heater 70 may be prevented.

Figure 12:
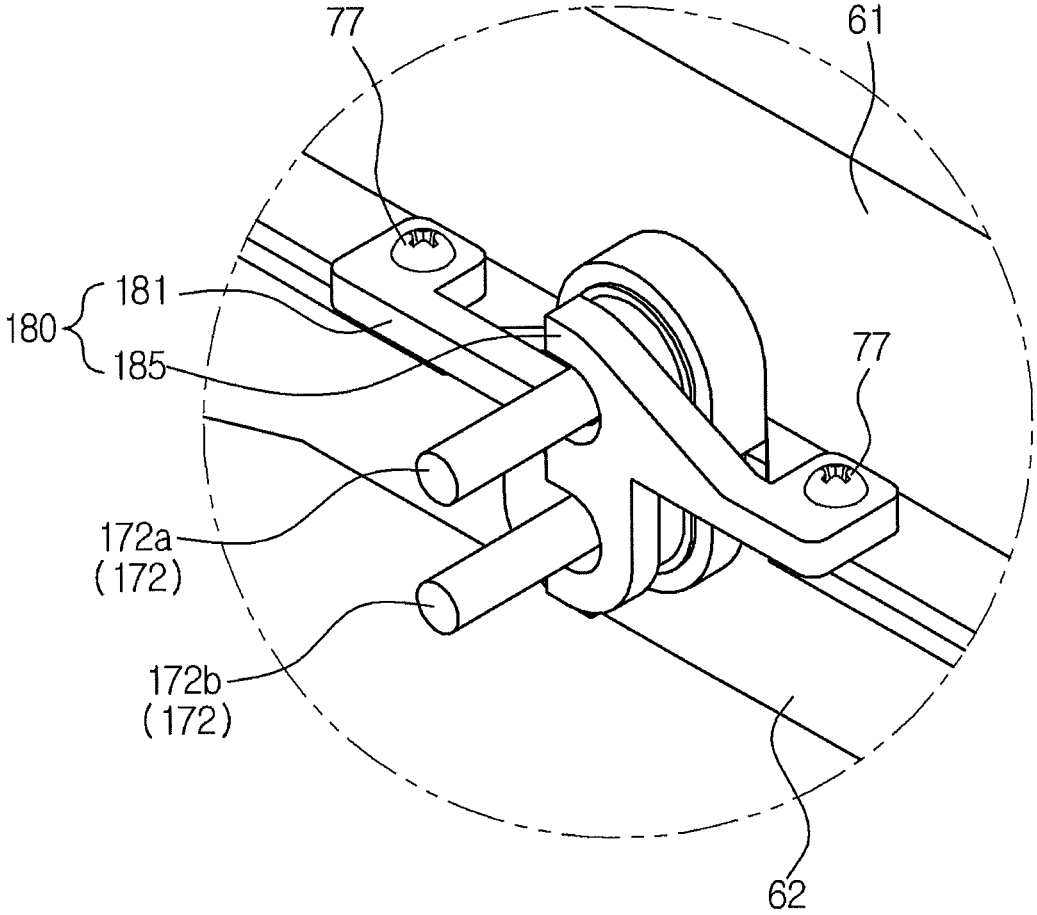
FIG. 12 is an enlarged view of a drying duct in accordance with another embodiment of the present disclosure.
Figure 13:
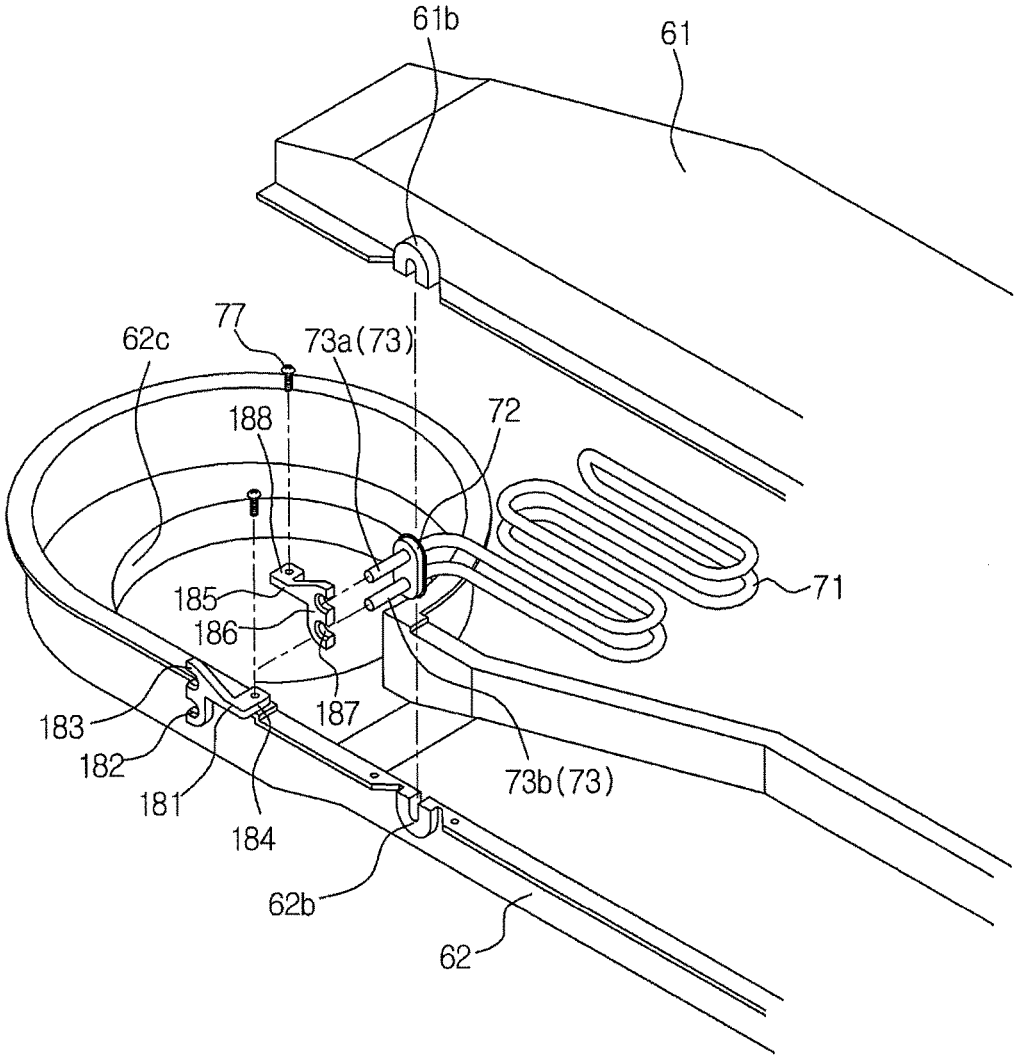
FIG. 13 is an exploded view of the drying duct in accordance with the embodiment of the present disclosure.

FIG. 12 is an enlarged view of a drying duct in accordance with another embodiment of the present disclosure, and FIG. 13 is an exploded view of the drying duct in accordance with the embodiment of the present disclosure.

As shown in FIGS. 12 and 13, a plurality of fixing units 180 to fix the heater 70 may be provided. The plurality of fixing units 180 may include a first fixing unit 181 having a first duct combination part 182 and a second fixing unit 185 having a second duct combination part 187. After the first fixing unit 181 is combined with terminals 172, the second fixing unit 185 may be combined with the terminals 172. Thereby, the second fixing unit 185 is located at the outermost region. Although FIGS. 12 and 13 illustrate the fixing units 180 as being combined with the drying duct 60 by fastening members 77, the embodiments of the present disclosure are not limited thereto.

In this case, the fixing units 180 located at both sides of the terminals 172*a* and 172*b* are combined with the terminals 172*a* and 172*b* and thus combined with the drying duct 60, and thus the heater 70 is more firmly fixed to the drying duct 60. Further, in order to fix the terminals 172*a* and 172*b* at both sides, heater combination parts 183 and 186 need not be combined with ½ or more of the diameter of the terminals 172*a* and 172*b*, and thus it is easy to design the fixing units 180.

Figure 14:
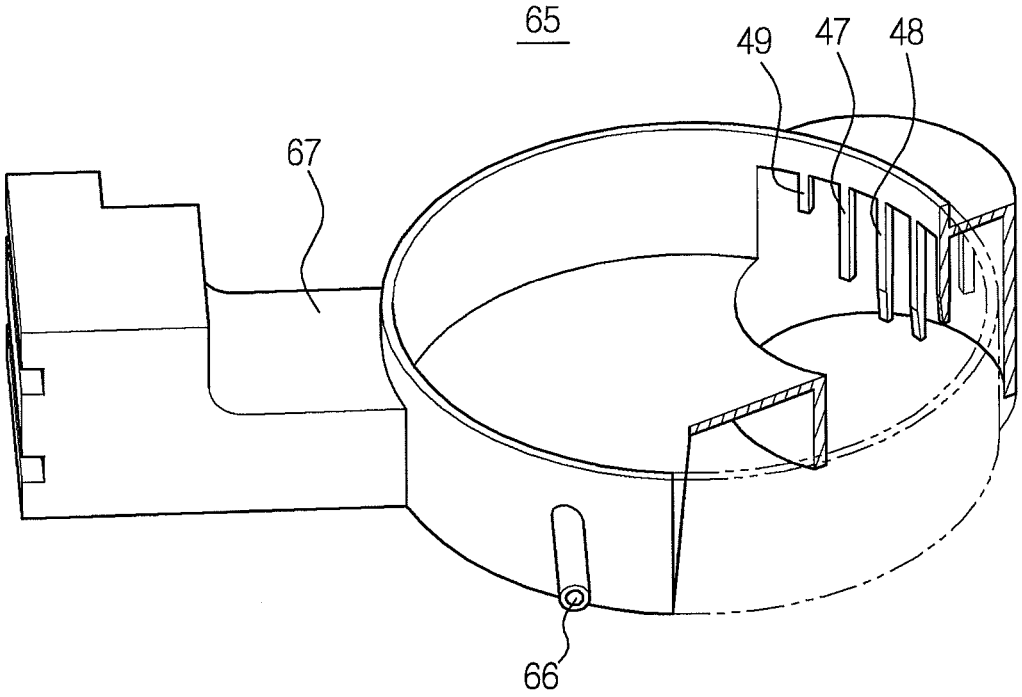
FIG. 14 is a view of a mount part in accordance with one embodiment of the present disclosure.

FIG. 14 is a view of a mount part in accordance with one embodiment of the present disclosure.

As shown in FIG. 14, a plurality of first lint collection parts 47 to prevent inflow of lint into the air blower fan 64 may be provided at one side of the mount part 65. The first lint collection parts 47 may be extended from the mount part 65 toward the tub 20. That is, the first lint collection parts 47 may be provided in the vertical direction.

The lengths of the plural first lint collection parts 47 may be different. From among the plural first lint collection parts 47, a first lint collection part located at the central region is defined as a first center lint collection part 48, and a first lint collection part located at the outer region is defined as a first outer lint collection part 49. The length of the first center lint collection part 48 may be greater than the length of the first outer lint collection part 49. The reason for this is that more lint tends to flow into the center of the drying duct 60 by the air blower fan 64 and such a structure effectively collects the lint.

The width of the first lint collection parts 47 may be decreased in the extension direction of the first lint collection parts 47 from the mount part 65. That is, the first lint collection parts 47 may be provided in a wedge shape. The width of the ends of the first lint collection parts 47 is narrow, and may thus guide capturing of the lint.

In accordance with one embodiment of the present disclosure, the first lint collection parts 47 are located on the mount part 65 in which the air blower fan 64 is located and thus, lint flowing in the direction of the air blower fan 64 is caught by the first lint collection parts 47 and inflow of the lint into the air blower fan 64 may be prevented.

Figure 15:
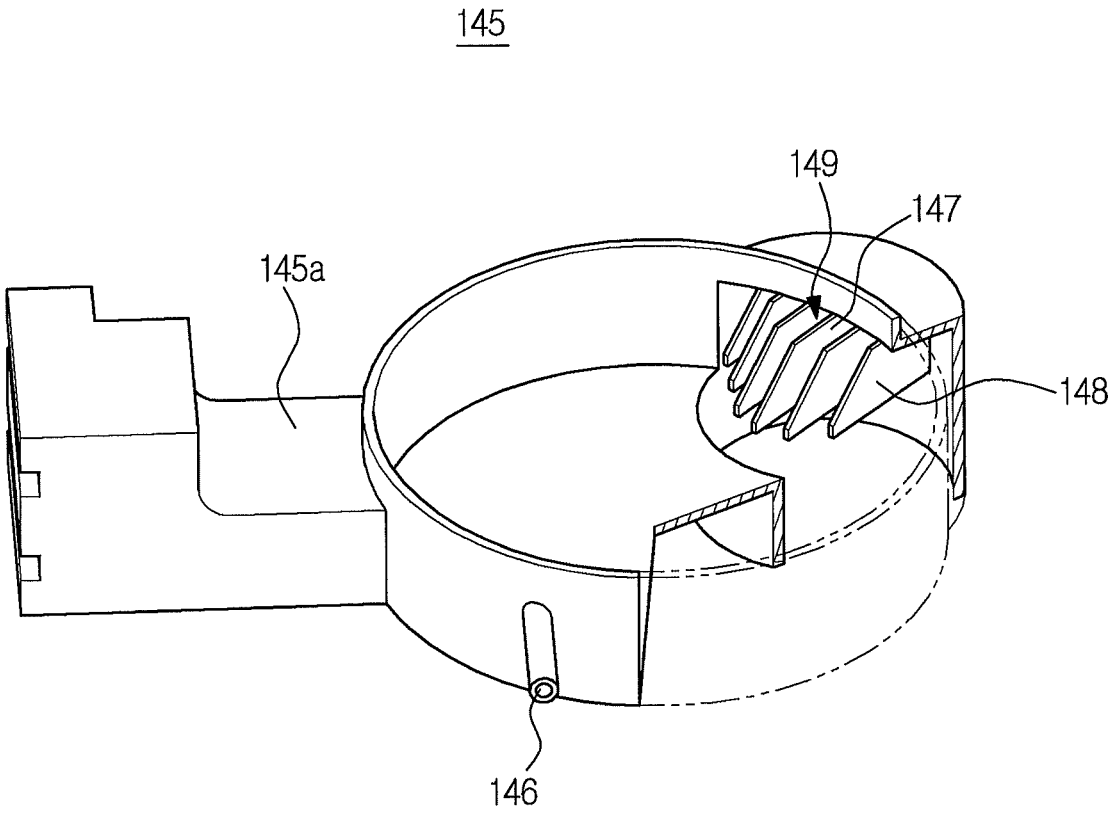
FIG. 15 is a view of a mount part in accordance with another embodiment of the present disclosure.

FIG. 15 is a view of a mount part in accordance with another embodiment of the present disclosure.

As shown in FIG. 15, lint collection parts 149 may be formed in various shapes. With reference to FIG. 15, the first lint collection parts 147 may be extended from the outer region of the mount part 145 to the center of the mount part 145. In this case, since the first lint collection parts 147 are located in the horizontal direction, an area of the mount part 145 occupied by the first lint collection parts 147 is further increased, and thus the first lint collection parts 147 may more effectively collect lint flowing into the air blower fan 64. The lengths of the lint collection parts 149 may be different, and the second lint collection parts 148 formed outside the first lint collection parts 147 may have a length less than the first lint collection parts 147.

Figure 16:
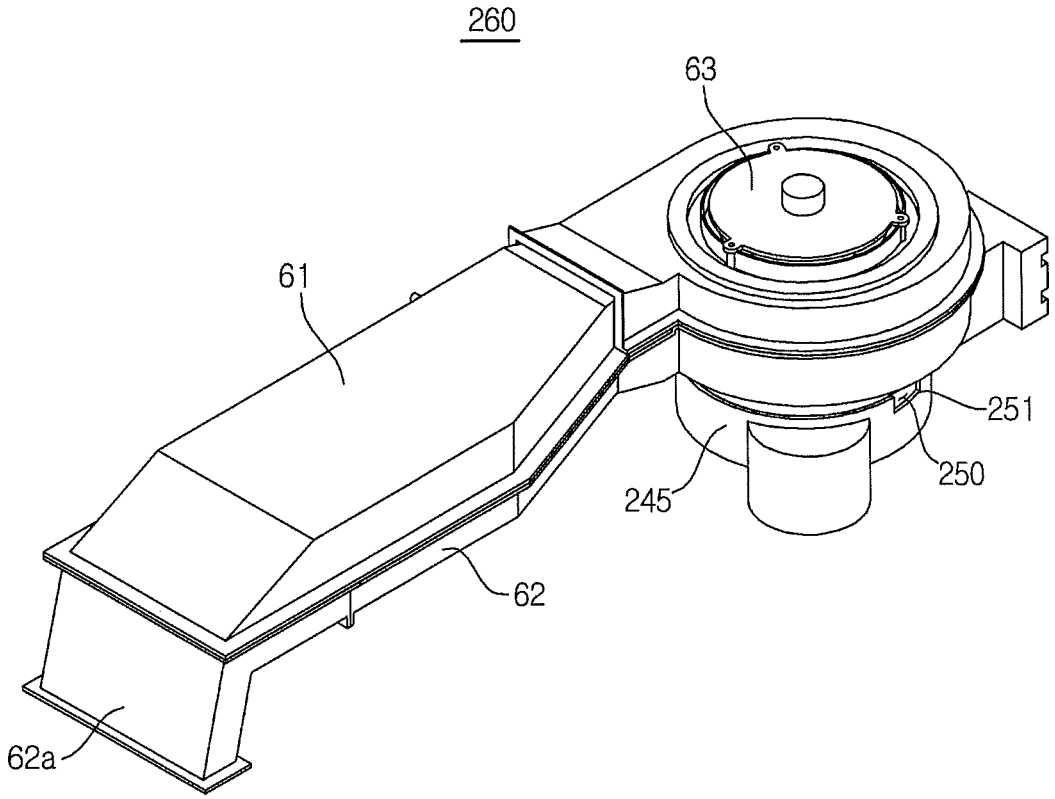
FIG. 16 is a view of a drying device in accordance with a further embodiment of the present disclosure.
Figure 17:
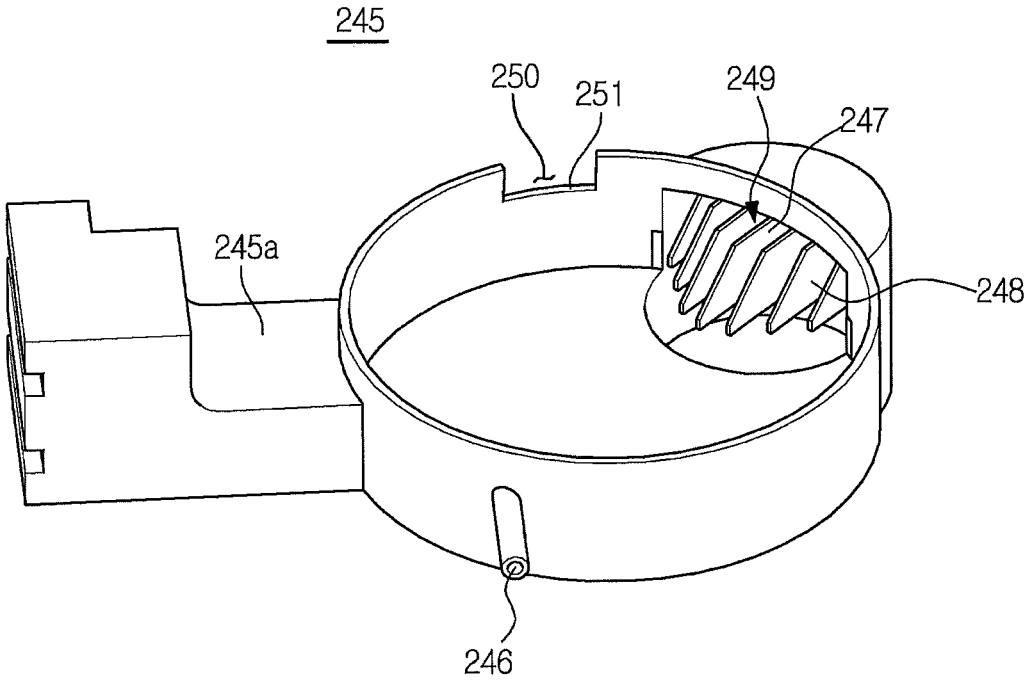
FIG. 17 is a view of a mount part in accordance with the embodiment of the present disclosure.
Figure 18:
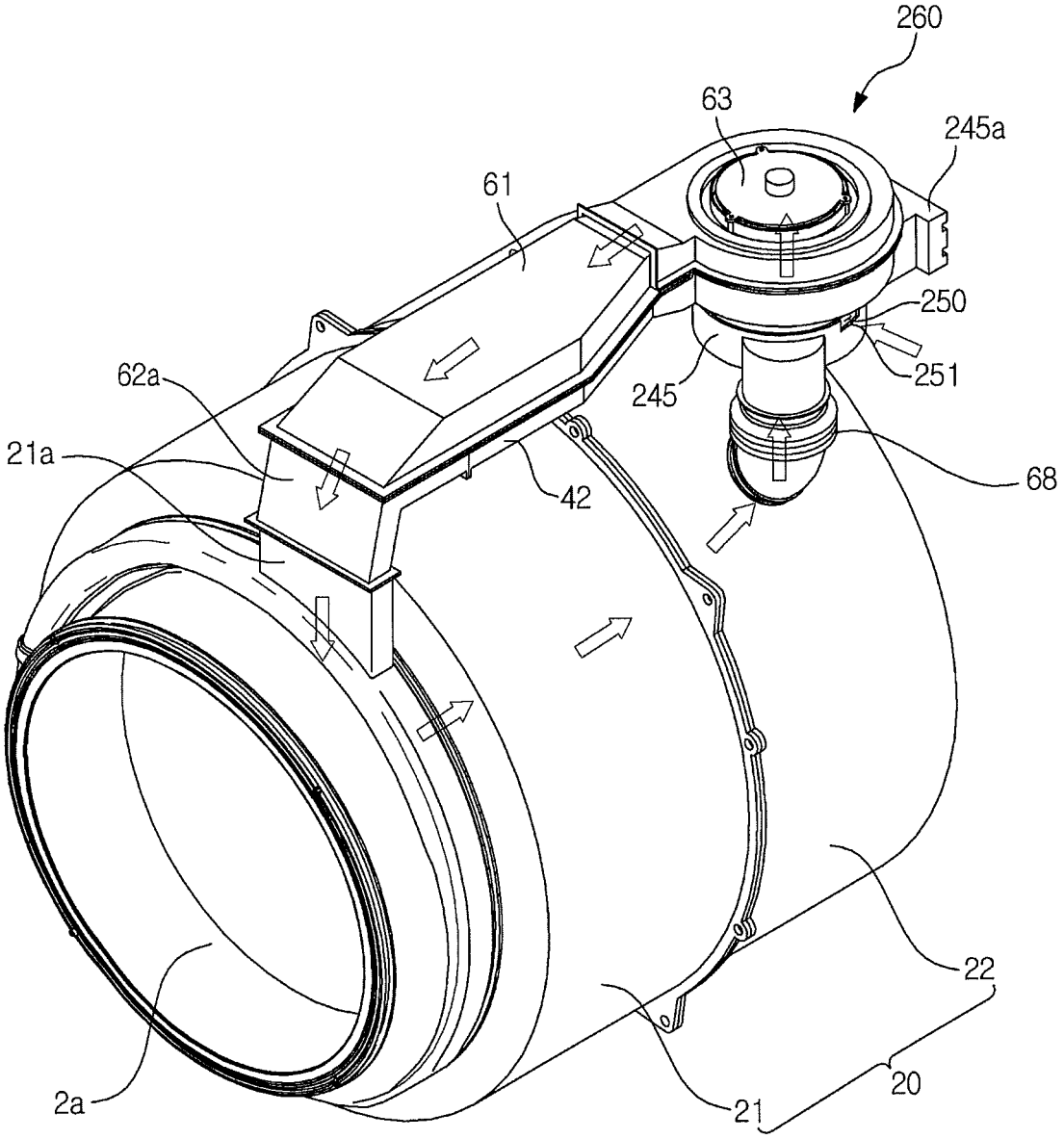
FIG. 18 is a view illustrating air flow of a drum washing machine in accordance with the embodiment of the present disclosure.

FIG. 16 is a view of a drying device in accordance with a further embodiment of the present disclosure, FIG. 17 is a view of a mount part in accordance with the embodiment of the present disclosure, and FIG. 18 is a view illustrating air flow of a drum washing machine in accordance with the embodiment of the present disclosure.

The embodiment of the present disclosure shown in FIGS. 16 to 18 differs from the embodiments of the present disclosure shown in FIGS. 14 and 15 in terms of the shape of the mount part 245. Some parts in this embodiment which are substantially the same as those in the former embodiments, i.e., the components denoted by reference characters 245*a*, 246, 247, 248 and 249, are denoted by the same reference numerals even though they are depicted in different drawings, and a detailed description thereof will thus be omitted because it is considered to be unnecessary.

A communication part 250 may be provided on at least one surface of the mount part 245 in accordance with the embodiment of the present disclosure. The communication part 250 may be formed by a concave surface 251 formed on at least a portion of the mount part 245. Although FIGS. 16 to 18 illustrate one communication part 250, the number of communication parts 250 is not limited thereto and plural communication parts 250 may be provided. Further, the communication part 250 may have various structures, such as a slit and a hole.

Air at the outside of the tub 20 may flow into the mount part 245 through the communication part 250 due to operation of the air blower fan within the mount part 245.

Hereinafter, air flow of the drum washing machine in accordance with this embodiment of the present disclosure will be described with reference to FIG. 18.

While laundry is rotated within the drum 25 (with reference to FIG. 1), the laundry is dried by air circulating in the tub 20. High-temperature and high-humidity air having absorbed moisture from the laundry within the drum 25 (with reference to FIG. 1) passes through the mount part 245 via the connection member 68, and then flows into the drying duct 260.

Dry air at the outside of the tub 20 flows into the mount part 245 through the communication part 250 due to operation of the air blower fan within the mount part 245.

Water contained in high temperature and high humidity air may be condensed through heat exchange with condensed water, or may be condensed through heat exchange with dry air flowing from the outside of the tub 20. Therefore, if the communication part 250 is provided on the mount part 245, drying by condensed water and condensation by dry air may occur and thus condensing efficiency may be increased.

As air condensed by condensed water or dry air passes through the drying duct 260, such air is heated by the heater 70 (with reference to FIG. 2) within the drying duct 260. Heated air flows into the tub 20 via the communication part 62*a* of the drying duct 260 and the front panel 21*a* extended from one side of the first tub part 21, and dries laundry within the drum 25 (with reference to FIG. 1) by absorbing moisture from the laundry. Moisture is removed from the laundry by repeating such a process, thus drying the laundry.

Figure 19:
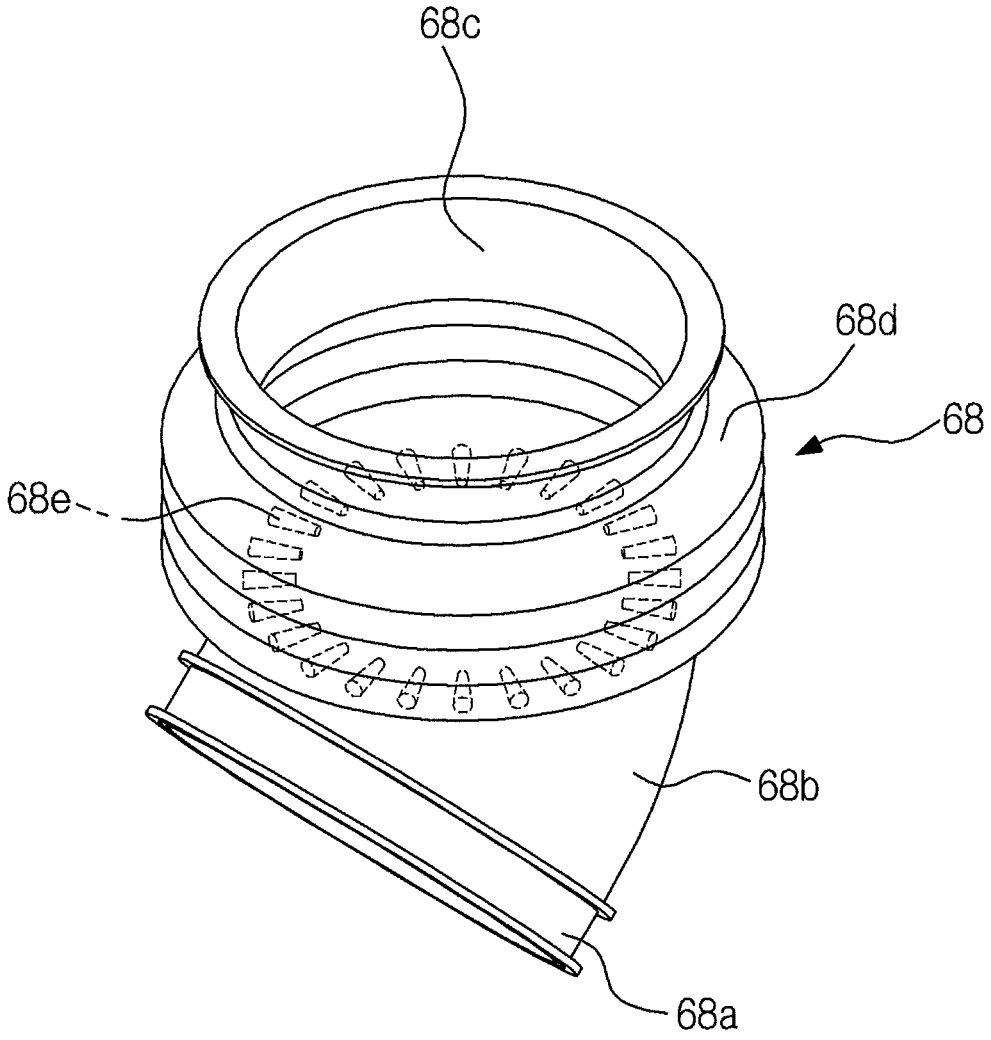
FIG. 19 is a view of a connection member in accordance with one embodiment of the present disclosure.
Figure 20:
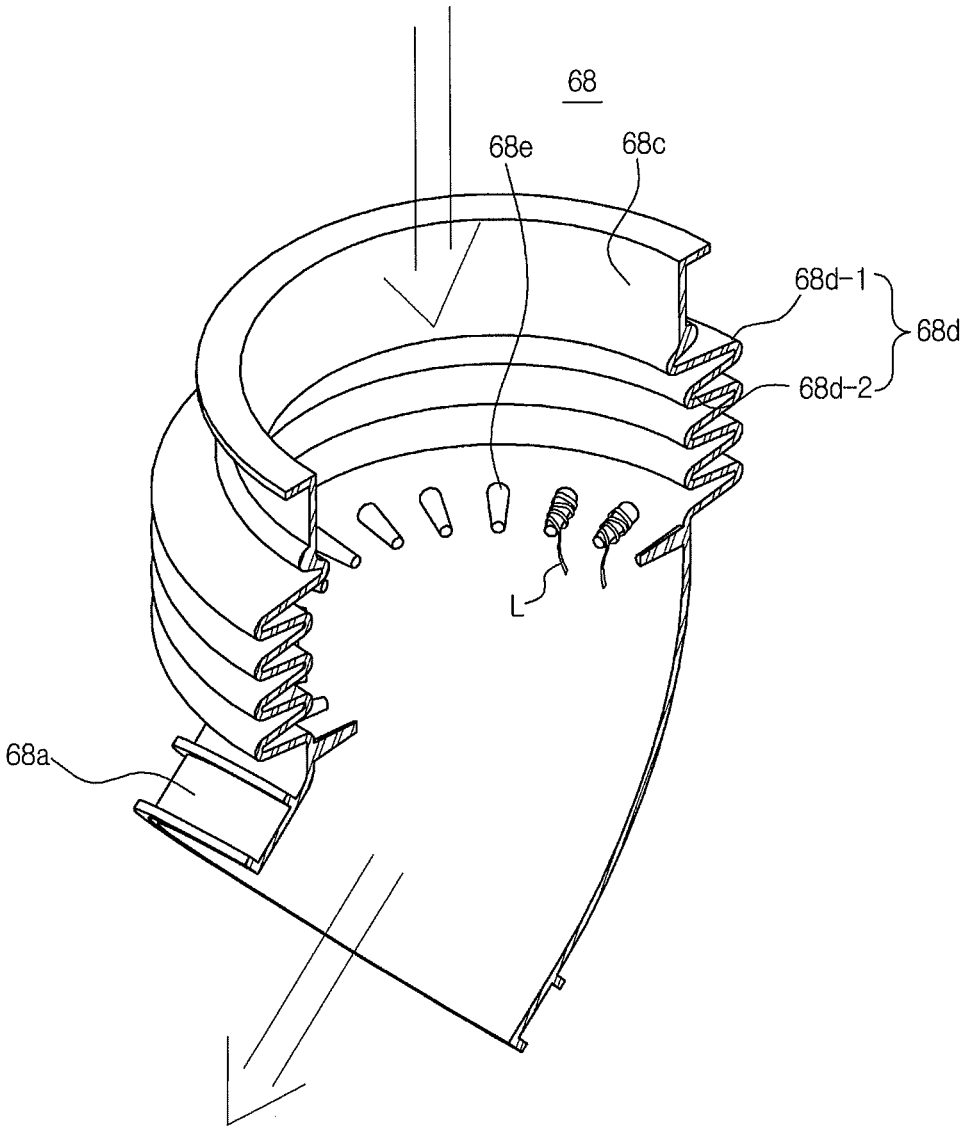
FIG. 20 is a view illustrating second lint collection parts of the connection member in accordance with the embodiment of the present disclosure, in a state in which lint is collected by the second lint collection parts.
Figure 21:
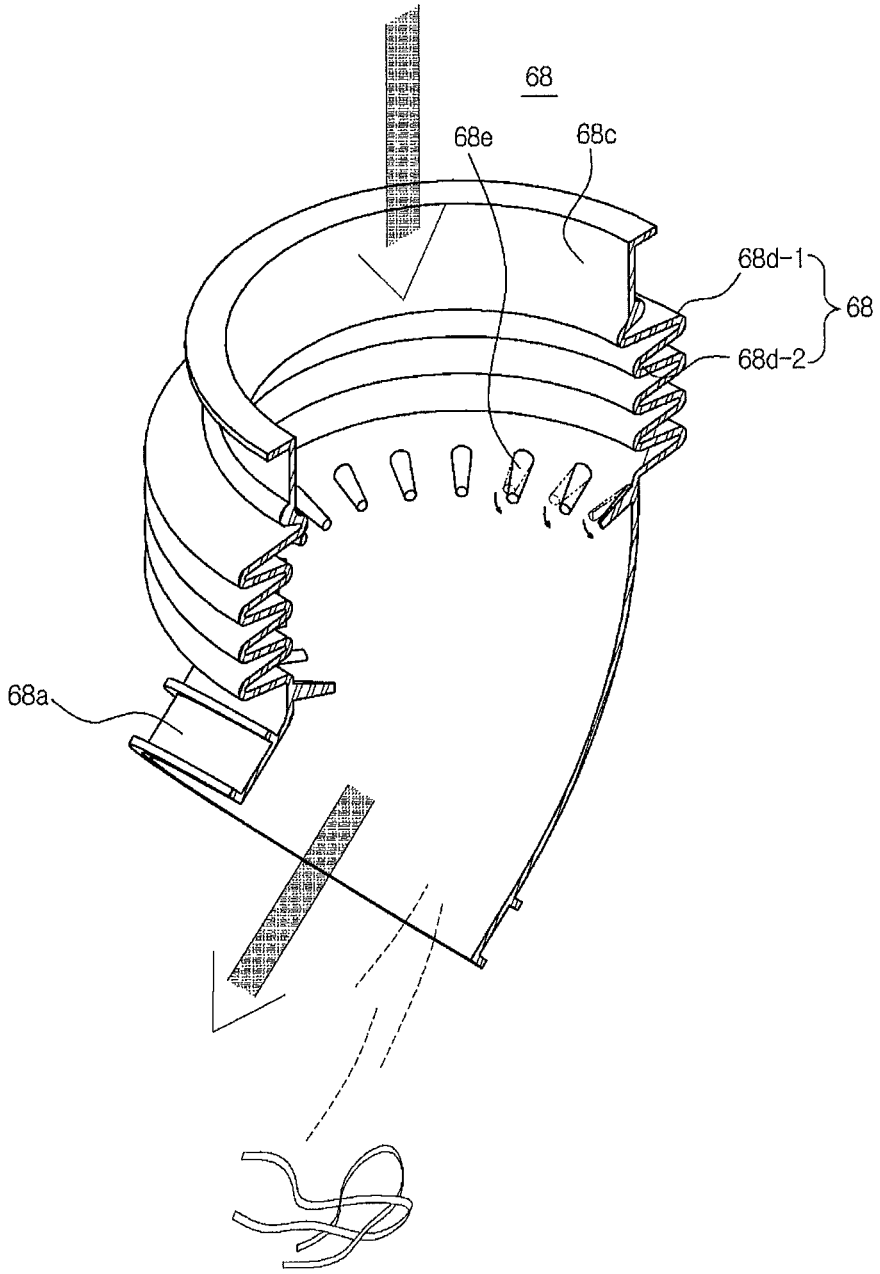
FIG. 21 is a view illustrating the second lint collection parts of the connection member in accordance with the embodiment of the present disclosure, in a state in which lint is washed off the second lint collection parts by water supply.

FIG. 19 is a view of a connection member in accordance with one embodiment of the present disclosure, FIG. 20 is a view illustrating second lint collection parts of the connection member in accordance with the embodiment of the present disclosure, in a state in which lint is collected by the second lint collection parts, and FIG. 21 is a view illustrating the second lint collection parts of the connection member in accordance with the embodiment of the present disclosure, in a state in which lint is washed off the second lint collection parts by water supply.

As shown in FIGS. 19 to 21, a plurality of second lint collection parts 68*e* protruding in the central direction of the connection member 68 to collect lint may be provided on the inner surface the connection member 68. In accordance with one embodiment of the present disclosure, the second lint collection parts 68*e* may be formed integrally with the connection member 68 by injection molding.

The connection member 68 may include a drying duct combination part 68*c* combined with the drying duct 60, and a tub combination part 68*a* combined with the tub 20. A corrugated part 68*d* to absorb vibration and impact generated from the tub 20 and the drying duct 60 may be provided between the drying duct combination part 68*c* and the tub combination part 68*a*. Protrusions 68*d*-1 and depressions 68*d*-2 are alternately arranged on the corrugated part 68*d*. The connection member 68 may expand and contract to some degree due to the corrugated part 68*d* and thus absorb vibration generated from the tub 20 and the drying duct 60.

A curved part 68*b* which is curved in the direction of the tub 20 may be provided between the drying duct combination part 68*c* and the tub combination part 68*a*. The curved part 68*b* serves to easily combine the connection member 68 with the tub 20. Due to the curved part 68*c*, the hole 24 with which the connection member 68 is combined need not be located in the direction vertical to the drying duct 60, and design flexibility is assured and the drum washing machine is easily assembled.

The connection member 68 is formed of a flexible material. This serves to effectively absorb vibration and noise energy generated from the tub 20 and the drying duct 60 through elastic shape deformation of the connection member 68. The connection member 68 may be formed of plastic having high vibration and noise attenuating characteristics, such as thermoplastic elastomer (TPE), thermoplastic olefin elastomer (TPO), thermoplastic polyurethane (TPU), thermoplastic polyamide (TPAE) or thermoplastic polyester elastomer (TPEE), or be an injection molded product formed of rubber, such as ethylene propylene diene monomer (EPDM).

The second lint collection parts 68*e* may be formed integrally with the connection member 68 by injection molding, or be formed of the same material as the connection member 68. Therefore, the second lint collection parts 68*e* are formed of a flexible material. If wash water is supplied to the inside of the drying duct 60, the respective second lint collection parts 68*e* are warped in the gravity direction in which wash water flows. In this case, lint L wound on the second lint collection parts 68*e* is washed away by the wash water, as shown in FIG. 21.

Figure 22:
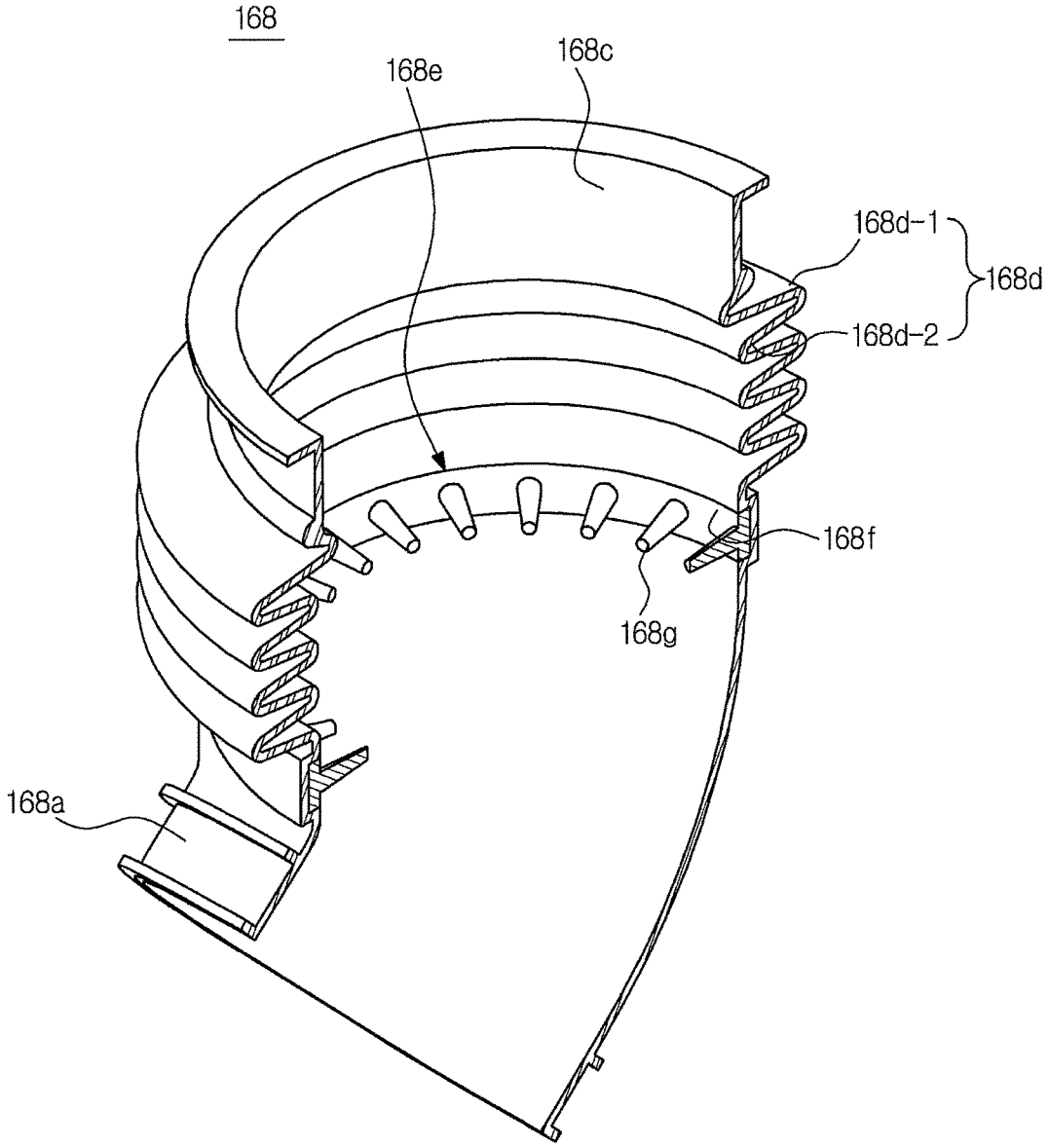
FIG. 22 is a view of a connection member in accordance with another embodiment of the present disclosure.

FIG. 22 is a view of a connection member in accordance with another embodiment of the present disclosure.

As shown in FIG. 22, in accordance with this embodiment of the present disclosure, a connection member 168 may be provided separately from a second lint collector 168*e*. The connection member 168 may include a drying duct combination part 168*c* combined with the drying duct 60, and a tub combination part 168*a* combined with the tub 20. A corrugated part 168*d* to absorb vibration and impact generated from the tub 20 and the drying duct 60 may be provided between the drying duct combination part 168*c* and the tub combination part 168*a*. Protrusions 168*d*-1 and depressions 168*d*-2 are alternately arranged on the corrugated part 68*d*. In this case, the second lint collector 168*e* may include a combination part 168*f* combined with the inner surface of the connection member 168, and protrusions 168*g* extended from the combination part 168*f*, located in the circumferential direction of the inner wall of the second lint collector 168*e*, and protruding to the center of the connection member 168.

Figure 23:
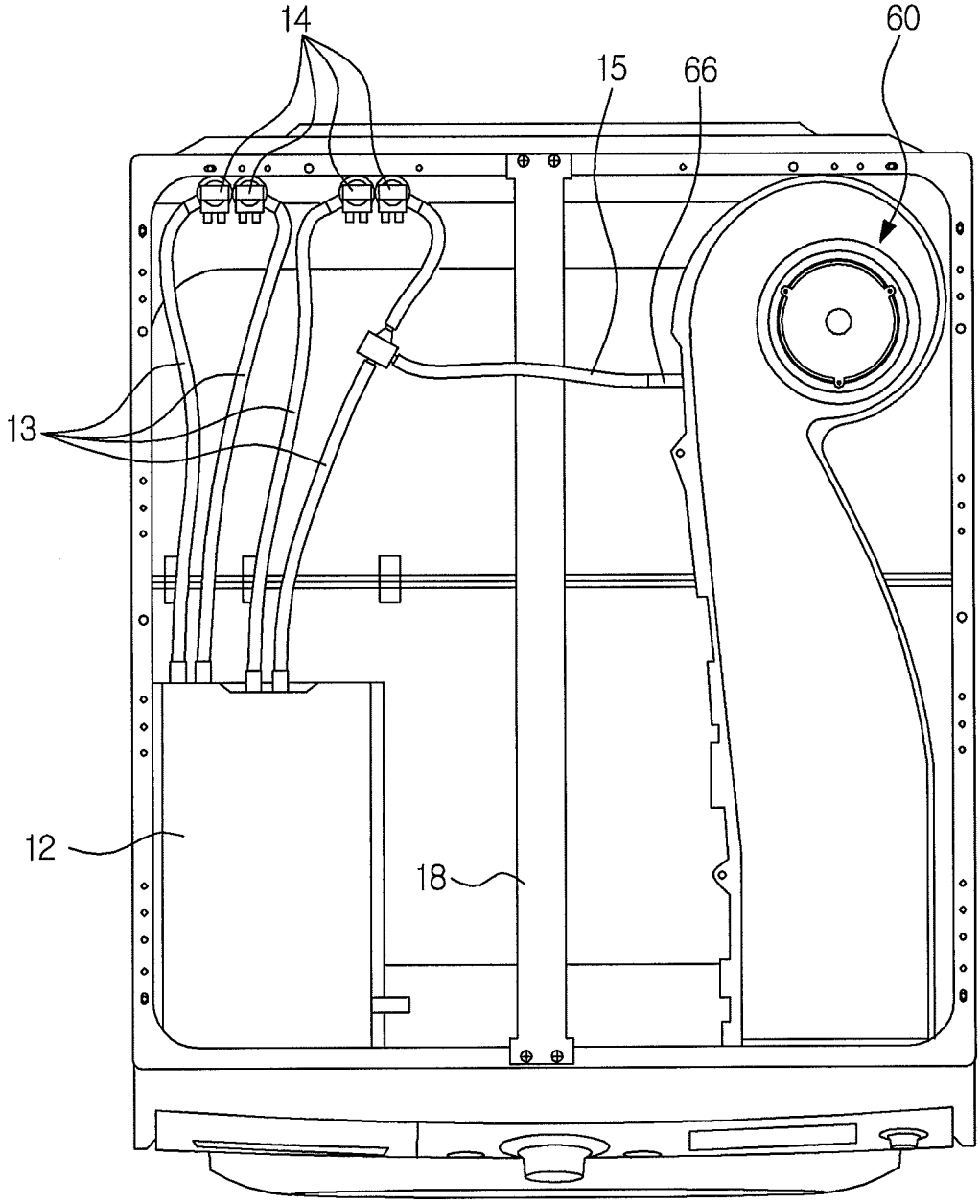
FIG. 23 is a view illustrating a water supply structure of a drying duct in accordance with one embodiment of the present disclosure.

FIG. 23 is a view illustrating a water supply structure of a drying duct in accordance with one embodiment of the present disclosure.

As shown in FIG. 23, the detergent supply device 12 is connected to the tub 20 through the connection pipe 16. Water supplied through the second water supply pipes 13 is supplied to the inside of the tub 20 together with detergent through the detergent supply device 12. The second water supply pipes 13 may be connected to second water supply switching valves 14 so as to adjust water supply. Wash water is supplied to the inside of the drying duct 60 through the water supply pipe connector 66 provided at one side of the drying duct 60. As wash water is injected into the drying duct 60, lint accumulated in the drying duct 60 may be washed away. A support panel 18 may be located at the upper portion of the cabinet 20.

In accordance with one embodiment of the present disclosure, the first water supply pipe 15 combined with the water supply pipe connector 66 of the drying duct 60 and supplying wash water may be branched from the second water supply pipe 13 connected to the detergent supply device 12. In this case, if wash water is supplied to the drum 25 through the tub 20, the wash water is supplied also to the drying duct 60. Therefore, lint within the drying duct 60 is frequently washed away and thus, lowering of the performance of the drum washing machine 1 due to accumulation of lint may be prevented.

Figure 24:
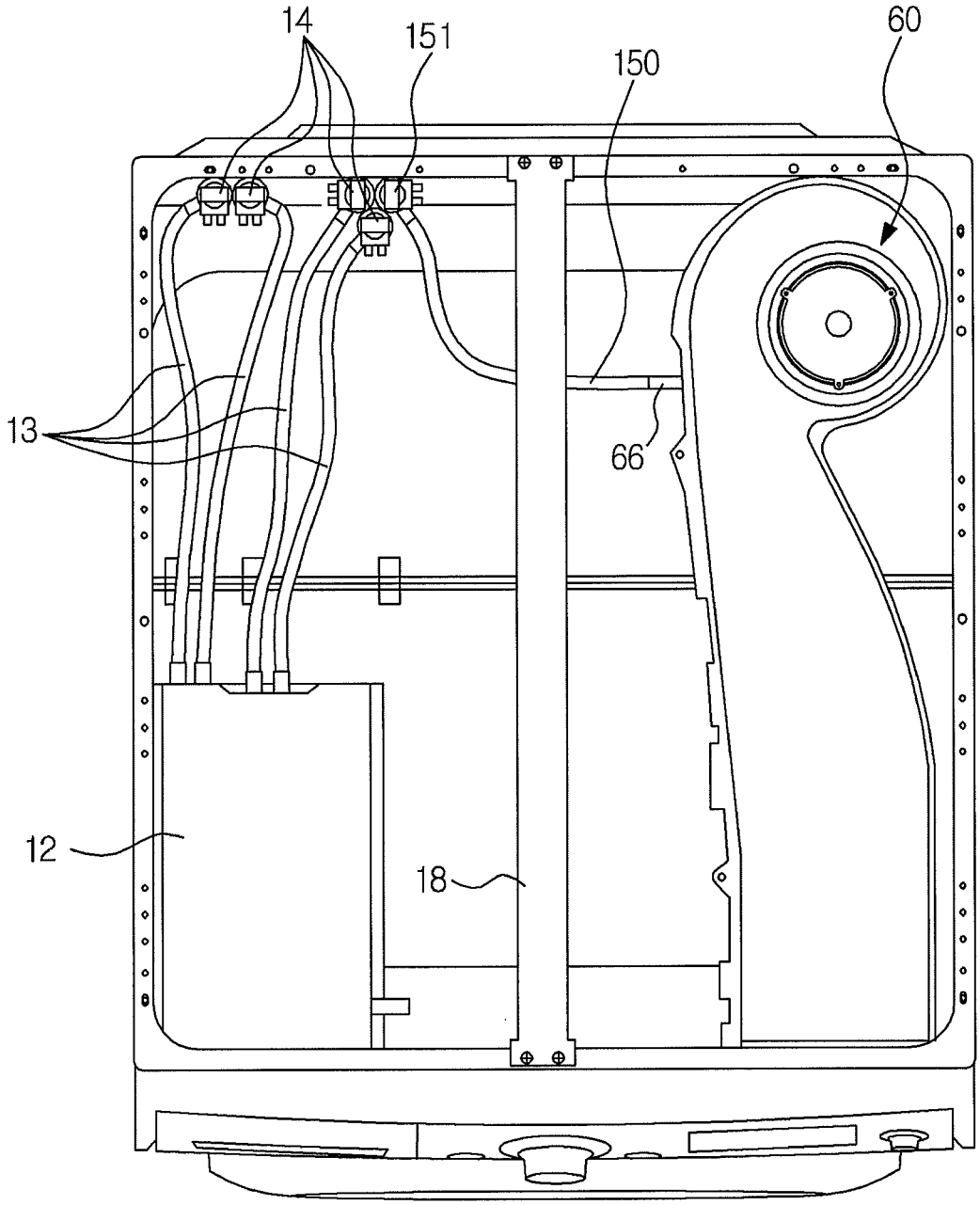
FIG. 24 is a view illustrating a water supply structure of a drying duct in accordance with another embodiment of the present disclosure.
Figure 25:
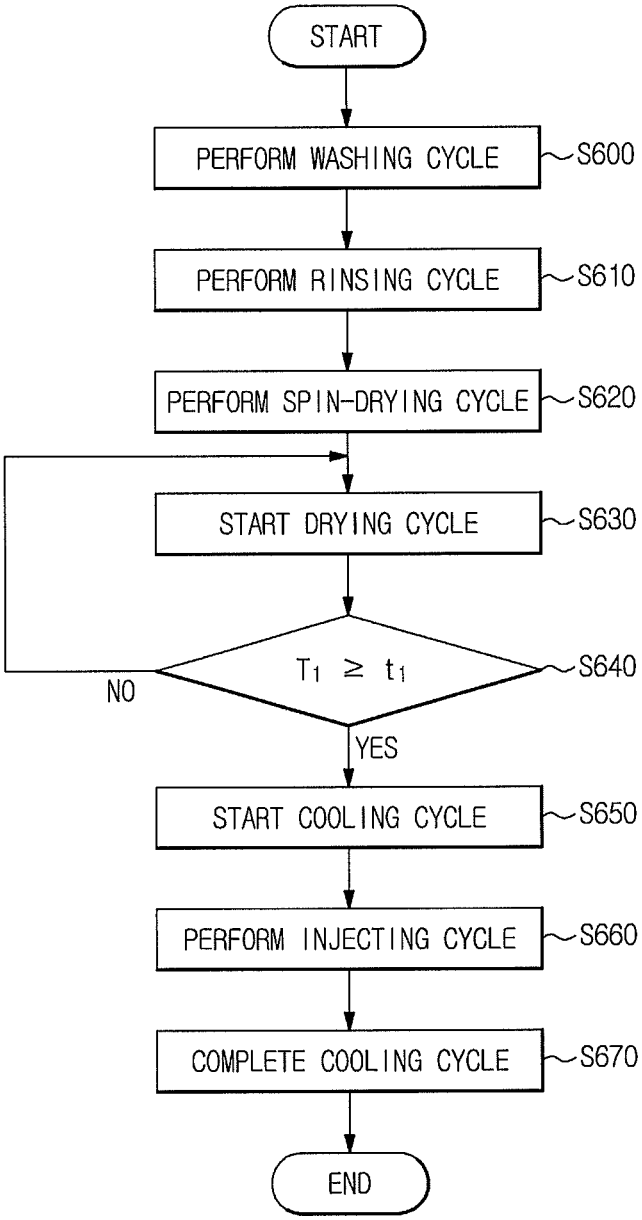
FIG. 25 is a flowchart illustrating operation of a drum washing machine in accordance with the embodiment of the present disclosure.

FIG. 24 is a view illustrating a water supply structure of a drying duct in accordance with another embodiment of the present disclosure, and FIG. 25 is a flowchart illustrating operation of a drum washing machine in accordance with the embodiment of the present disclosure.

In accordance with this embodiment of the present disclosure, as shown in FIG. 24, a first water supply pipe 150 combined with a water supply pipe connector 66 of a drying duct 60 may be combined with a separate external water supply source (not shown). Further, a first water supply switching valve 151 to adjust the amount of wash water supplied to the first water supply pipe 150 may be combined with the first water supply pipe 150. In this case, independently of wash water supplied to the drum 25, the amount and supply time of wash water supplied to the drying duct 60 may be adjusted. A detailed description thereof will be given later.

Hereinafter, a process of washing, rinsing, spin-drying, drying and cooling cycles of the drum washing machine in which the first water supply pipe is combined with a separate external water supply source (not shown) to adjust wash water flowing into the drying duct, as shown in FIG. 24, will be described in brief.

When the washing cycle is started after laundry is put into the drum, wash water supplied through the water supply pipes passes through the detergent supply device and is supplied together with detergent into the tub and the drum (Operation S600).

When supply of wash water is completed, the drum is rotated by the motor installed on the outer rear surface of the tub and rotating the drum and thus, washing of the laundry is performed (Operation S600).

When the washing cycle (Operation S600) is completed, wash water is supplied to the tub and thus, the rinsing cycle is started (Operation S610). After the rinsing cycle (Operation S610) is completed, the spin-drying cycle (Operation S620) is performed.

After the spin-drying cycle (Operation S620) is completed, the drying cycle is started (Operation S630).

When the drying cycle is started, whether or not a time t1 left until the end point of time of the drying cycle is shorter than a predetermined time T1 is judged (Operation 640). Upon judging that the time t1 left until the end point of time of the drying cycle is shorter than the predetermined time T1, the cooling cycle is started (Operation S650). In the cooling cycle, the heater is turned off, and the air blower fan is periodically turned on and off. This serves to prevent a user from being exposed to high temperature air emitted through the door when the user opens the door after the drying cycle of the drum washing machine is completed. The cooling cycle may be started if the time t1 left until the end point of time of the drying cycle is about 5 to 10 minutes.

The air blower fan may be turned on after the air blower fan is turned off for at least 5 seconds. This serves to secure a time taken to completely turn the air blower fan off. In accordance with one embodiment of the present disclosure, the air blower fan may be set such that the air blower fan is turned on for 20 seconds and is turned off for 10 seconds during the cooling cycle.

When the cooling cycle is started (Operation 650), an injecting cycle in which wash water is injected from the first water supply pipe into the drying duct is performed (Operation S660) and the cooling cycle is subsequently completed (Operation S670). The injecting cycle may be performed during at least one of the drying cycle and the cooling cycle.

The injecting cycle may prevent lint from being accumulated within the drying duct. Particularly, if the injecting cycle is performed during the cooling cycle, the air blower fan is periodically turned off and thus, accumulation of lint on the air blower fan due to inflow of the lint from the tub into the drying duct may be prevented. Further, as the injecting cycle is performed together with the cooling cycle, the lint within the drying duct may be washed away.

Figure 26:
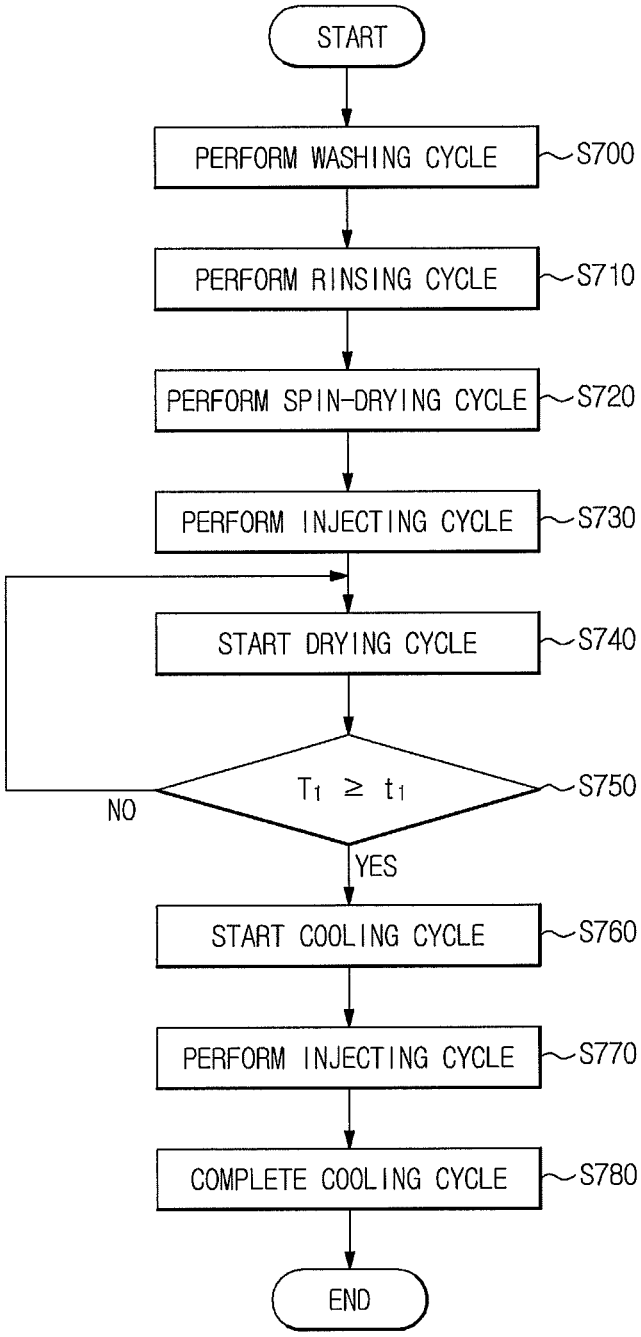
FIG. 26 is a flowchart illustrating operation of a drum washing machine in accordance with yet another embodiment of the present disclosure.

FIG. 26 is a flowchart illustrating operation of a drum washing machine in accordance with yet another embodiment of the present disclosure.

As shown in FIG. 26, after the washing cycle (Operation S700), rinsing cycle (Operation S710) and spin-drying cycle (Operation S720) are performed, the injecting cycle may be performed (Operation S730). In this case, the drying cycle is started (Operation S740) after the injecting cycle (Operation S730) is completed, whereby a time t1 left until the end point of time of the drying cycle is shorter than a predetermined time T1 is judged (Operation 750), and thus accumulation of lint generated during the spin-drying cycle may be prevented.

Further, after the cooling cycle in which the heater is turned off and the air blower fan is periodically turned on/off is started (Operation S760), the injecting cycle is separately performed (Operation S770) and the cooling cycle is subsequently completed (Operation S780). Therefore, lint accumulated in the drying duct during the drying cycle is washed away through the injecting cycle (S770) during the cooling cycle, and thus a possibility of accumulation of lint in the drying duct may be reduced.

As is apparent from the above description, a drum washing machine in accordance with one embodiment of the present disclosure improves the structure of a tub to effectively inject condensed water, and may thus increase condensing efficiency. Further, the drum washing machine improves the structure of the tub and the structure of a drying duct, and may thus prevent accumulation of lint and lowering of performance of the drum washing machine.

A drum washing machine in accordance with another embodiment of the present disclosure improves the structure of a drying device and the structure of a connection member connecting the drying device to a tub, and may thus effectively remove lint by collecting the lint. Therefore, the drum washing machine may prevent lowering of performance of the drying device due to accumulation of lint within the drying device.

Further, a drum washing machine in accordance with yet another embodiment of the present disclosure may increase condensing efficiency of high humidity air having absorbed moisture from laundry through improvement of the structure of a mount part.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A drum washing machine comprising:
a cabinet;
a tub disposed within the cabinet;
a drum rotatably disposed within the tub;
a drying duct for flowing air for drying of laundry in the drum;
wherein the drying duct comprises
an upper plate;
a lower plate;
an air blower fan for circulation of air;
a mount part combined with a lower portion of the lower plate, the air blower fan being mounted in the mount part;
a connection member to connect the mount part with the tub, the mount part being located between the connection member and the lower plate;
a water supply pipe connector formed at one side of the mount part to inject wash water to the air blower fan; and
a plurality of first lint collection parts formed at an upper half of an inner circumferential surface of the mount part, each of the plurality of first lint collection parts being spaced apart from each other and configured to protrude vertically downward from the upper half of the inner circumferential surface of the mount part toward the tub to prevent inflow of lint into the air blower fan; and
a plurality of second lint collection parts protruding from an inner surface of the connection member toward a center of the connection member to collect lint.

2. The drum washing machine according to claim 1, wherein the plurality of first lint collection parts also extend radially inward from the inner circumferential surface of the mount part toward a center of the mount part.

3. The drum washing machine according to claim 1, wherein vertical dimensions of the plurality of first lint collection parts are different.

4. The drum washing machine according to claim 1, wherein the width of the plurality of first lint collection parts is decreased in the extension direction of the plurality of first lint collection parts from the mount part.

5. The drum washing machine according to claim 1, wherein the plurality of second lint collection parts is provided so as to surround the inner surface of the connection member.

6. The drum washing machine according to claim 1, wherein the plurality of second lint collection parts is formed of a flexible material.

7. The drum washing machine according to claim 1, wherein at least one communication part into which dry air at the outside of the tub flows is provided on at least one surface of the mount part.

8. The drum washing machine according to claim 7, wherein the at least one communication part is formed by a concave surface formed on at least a portion of the mount part.

9. A drum washing machine comprising:
a cabinet;
a tub disposed within the cabinet;
a drum rotatably disposed within the tub; and
a drying duct in which an air blower fan circulating air to perform drying of laundry in the drum is located,
wherein the drying duct comprises
an upper plate;
a lower plate;
a mount part combined with a lower portion of the lower plate, the air blower fan being mounted in the mount part;
a connection member to connect the mount part to the tub, the mount part being located between the connection member and the lower plate;
first lint collection parts formed at an upper half of an inner circumferential surface of the mount part, the first lint collection parts being spaced apart from each other and configured to protrude vertically downward from the upper half of the inner circumferential surface of the mount part toward the tub to prevent inflow of lint into the air blower fan;
second lint collection parts provided on an inner surface of the connection member, the second lint collection parts include a plurality of protrusions formed in a circumferential direction of the inner surface of the connection member.

10. The drum washing machine according to claim 9, wherein the first lint collection parts also extend radially inward from the inner circumferential surface of the mount part toward a center of the mount part.

* * * * *